United States Patent [19]

Komatsu et al.

[11] Patent Number: 4,990,432

[45] Date of Patent: Feb. 5, 1991

[54] SILVER HALIDE PHOTOGRAPHIC LIGHT-SENSITIVE MATERIAL HAVING A REFLECTIVE BASE AND AN ANTIHALATION LAYER HAVING A SPECIFIED THICKNESS

[75] Inventors: Hajime Komatsu, Koganei; Susumu Ohkawachi, Odawara; Yasuo Tosaka, Sagamihara; Bunzo Ueda; Keiichi Hoshimo, both of Odawara, all of Japan

[73] Assignee: Konishiroku Photo Industry Co., Ltd., Tokyo, Japan

[21] Appl. No.: 440,484

[22] Filed: Nov. 24, 1989

Related U.S. Application Data

[63] Continuation of Ser. No. 94,251, Sep. 4, 1987, abandoned.

[30] Foreign Application Priority Data

Sep. 4, 1986 [JP] Japan ..... 61-208521
Sep. 4, 1986 [JP] Japan ..... 61-208524
Sep. 4, 1986 [JP] Japan ..... 61-208525

[51] Int. Cl.[5] ..... G03C 1/84; G03C 7/00; G03C 1/435

[52] U.S. Cl. ..... 430/378; 430/379; 430/409; 430/410; 430/510; 430/512; 430/538

[58] Field of Search ..... 430/510, 512, 538, 378, 430/379, 409, 410

[56] References Cited

U.S. PATENT DOCUMENTS

| | | | |
|---|---|---|---|
| 2,566,180 | 8/1951 | Fallesen et al. | 430/378 |
| 3,650,753 | 3/1972 | Bacon | 430/510 |
| 4,144,064 | 3/1979 | Vermeulen et al. | 430/510 |
| 4,296,198 | 10/1981 | Trautweiler | 430/403 |
| 4,355,099 | 10/1982 | Trautweiler | 430/531 |
| 4,395,478 | 7/1983 | Hoyen | 430/378 |
| 4,444,871 | 4/1984 | Miyaoka et al. | 430/378 |
| 4,477,559 | 10/1984 | Iwamuro et al. | 430/505 |
| 4,548,898 | 10/1985 | Yamada et al. | 430/510 |
| 4,563,406 | 1/1986 | Ohbayashi et al. | 430/510 |
| 4,581,323 | 4/1986 | Fisher et al. | 430/510 |
| 4,582,780 | 4/1986 | Giusto et al. | 430/510 |
| 4,752,559 | 6/1988 | Helland et al. | 430/510 |

FOREIGN PATENT DOCUMENTS

| | | | |
|---|---|---|---|
| 0089101 | 9/1983 | European Pat. Off. . | |
| 187846 | 8/1987 | Japan | 430/510 |
| 141049 | 6/1988 | Japan | 430/510 |
| 839484 | 6/1960 | United Kingdom . | |

OTHER PUBLICATIONS

Research Disclosure RD 17643, "Photographic Silver Halide Emulsions, Preparations, Addenda, Processing and Systems," 12/78, pp. 22-31.

Japanese Abstracts J61-77052 (A), "Silver Halide Color Photographic Sensitive Material," Konishiroku, 4/86.

*Primary Examiner*—Paul R. Michl
*Assistant Examiner*—Patrick A. Doody
*Attorney, Agent, or Firm*—Finnegan, Henderson, Farabow, Garrett, and Dunner

[57] ABSTRACT

A silver halide photographic light-sensitive material comprising a reflective support having a transmission density of not more than 0.8, having thereon, a photographic component layer comprising a silver halide emulsion layer and a layer including at least one antihalation layer formed closer to said support than said silver halide emulsion layer is disclosed. In the photographic material, degradation of image sharpness due to use of a reflective support having low transmission density is prevented.

3 Claims, 1 Drawing Sheet

SILVER HALIDE PHOTOGRAPHIC LIGHT-SENSITIVE MATERIAL HAVING A REFLECTIVE BASE AND AN ANTIHALATION LAYER HAVING A SPECIFIED THICKNESS

This application is a continuation of application Ser. No. 07/094,251, filed Sept. 4, 1987, now abandoned.

FIELD OF THE INVENTION

The present invention relates to silver halide photographic light-sensitive materials and, more particularly, to a silver halide photographic light-sensitive material having a reflective support.

BACKGROUND OF THE INVENTION

A great demand exists for thinner photographic light-sensitive materials. Hitherto, a support used in photographic materials, or more particularly a reflective support, has been usually such that its thickness is of the order of 200~250 μm. However, especially when as is often the case in recent years, a photographic material in its image-printed state is used to provide conference materials, reports, and so on, if the photographic material is one having a base of aforesaid conventional type, it is too thick for the purpose, involving difficulties in that when many pieces of such material are to be filed or stored, their bulkiness causes handling inconvenience and in that when they are recopied, a shade line or lines may appear on a copied image.

In view of these difficulties, attempts have been made to produce a less thick photographic material, but so far these attempts have not been successful from the standpoint of quality. One particular difficulty is that the use of a thinner support leads to a reduced transmission density and a lowered degree of opacity. As a natural consequence, there will be caused a drop in image sharpness by halation or otherwise. Therefore, any outcome of the prior art attempts has been far from being satisfactory from the standpoint of practical use.

SUMMARY OF THE INVENTION

The first object of this invention is intended to overcome aforesaid difficulties and has as its primary object the provision of a silver halide photographic light-sensitive material which can restrain any possible drop in image sharpness even if the reflective support used in the material is of a low transmission density.

The second object of the invention is to obtain a photographic material having a high contrast in highlight region, a characteristic curve with a clear-cut toe and an excellent reproducibility of dot images.

The above objects of the invention are achieved by a silver halide photographic light-sensitive material comprising a reflective support having a transmission density of not more than 0.8, having thereon, a photographic component layer comprising a silver halide emulsion layer and a layer comprising at least one antihalation layer formed closer to said support than said silver halide emulsion layer.

BRIEF DESCRIPTION OF THE DRAWING

The single

DETAILED DESCRIPTION OF THE INVENTION

Figure 1:
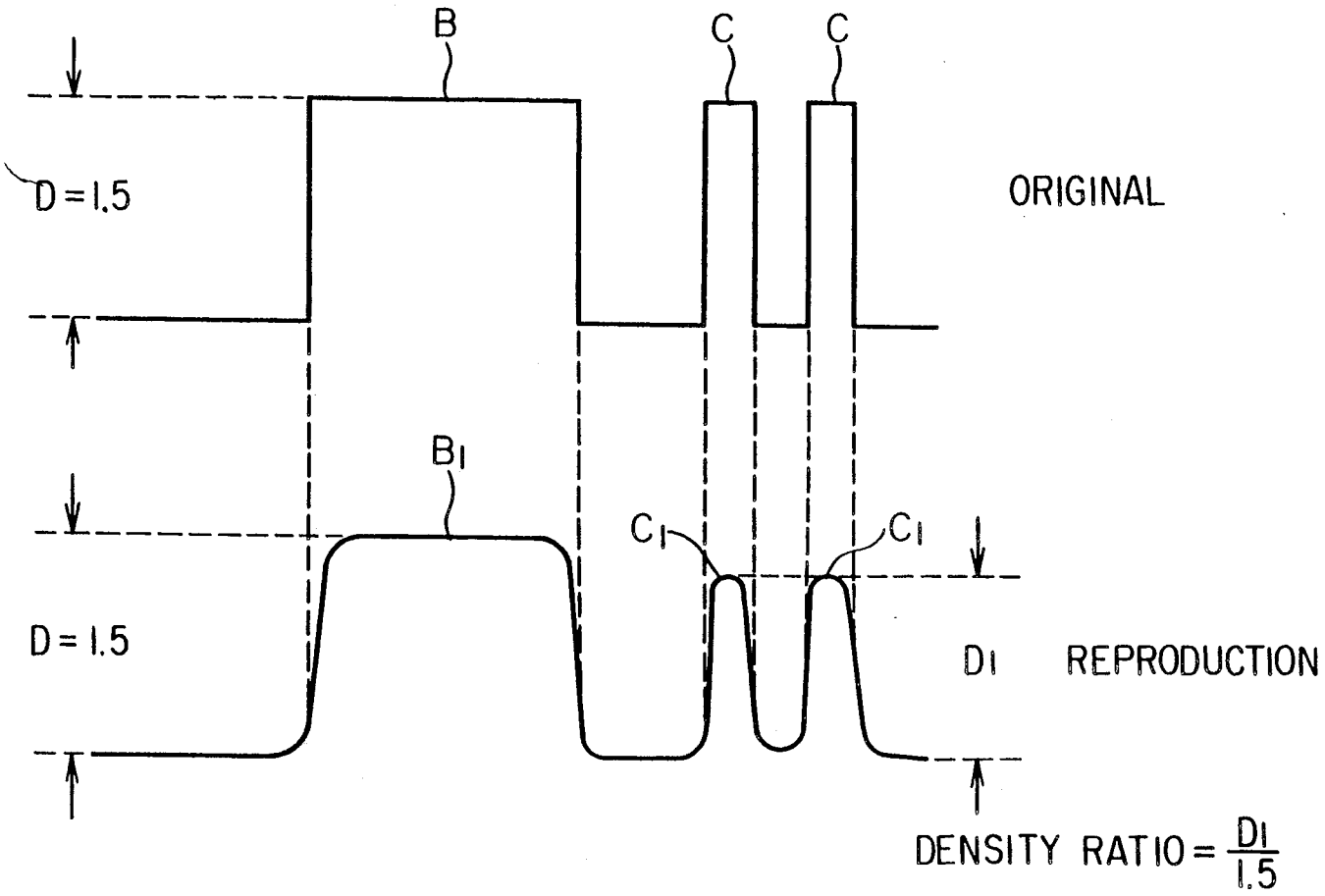
FIG. 1 is an explanatory view for the manner of evaluating image sharpness. In the figure, B, C, are image of original charts; $B_1$, $C_1$ are reproduced image of the charts after exposure and development.

According to the invention, the reflective support used therein has a transmission density of not more than 0.8, which fact permits the support to be of a satisfactorily thinness. Further, the provision of the antihalation layer allows sufficient image sharpness to be obtained even if the transmission density is low.

In the present invention, any desired reflective support may be used insofar as its transmission density is not more than 0.8. For example, a paper support, a support comprising a paper sheet as a substrate and a resin coat placed thereon, or a synthetic paper support may be used as desired.

There is no particular limitation as to the surface characteristics of the reflective support used in the invention, but it is desirable that the surface of the support have good resistance to water.

Such water resistant surface can be provided by covering a substrate, e.g., a paper substrate, with a hydrophobic resin coat. In the case where the support has such water resistant surface formed thereon, the base can be prevented from becoming wet when the silver halide photographic material is immersed in a bath used for development processing.

For example, by coating melt polyolefin on a paper substrate through extrusion coating to form a water resistant surface it is possible to obtain a highly water resistant polyolefin-laminated paper base.

For resins useful for forming a hydrophobic resin coat on the surface of a substrate may be mentioned, by way of example, polyolefins, such as polyethylene, polypropylene, and polybutene, or copolymer of olefins, such as ethylene, propylene, and butene, and monomers, such as vinyl acetate, vinylidene chloride, and maleic anhydride, e.g., ethylene vinyl acetate copolymer, propylene-vinylidene chloride copolymer, propylene-maleic anhydride copolymer, and the like; and homopolymers or copolymers of such resins as polystyrene, polyvinyl chloride, polyacrylates, saturated polyesters, and polycarbonates, or blends thereof. There is no particular limitation as to the thickness of such hydrophobic resin coat, but generally it is desirable that the thickness of such coat is of the order of 15~50 μm.

Where a polyethylene resin is used, there is no particular limitation as to its molecular weight insofar as extrusion coating is applicable, but normally such resin having a molecular weight range of 20,000~200,000 is used. The polyethylene resin used for such hydrophobic resin coat may be a low-density or medium-density or high-density polyethylene; any of these polyethylenes may be used alone or two or more kinds of them may be used in combination.

A fine-particle powdery material having a higher heat resistance than such resin, for example, a white pigment, such as $BaSO_4$, ZnO, $TiO_2$, may be used in mixture with the resin in order to obtain an opaque base. For this purpose, the ingredients are mixed well and the mixture is subjected to extrusion or drawing so that voids are created in the resulting coat so as to produce whitening effect, or a plurality of coats of such mixture are bonded together, whereby an opaque white base having a high transmission density can be obtained.

Next, an emulsion used for forming a silver halide emulsion layer in the invention will be explained.

The composition of the silver halide in the emulsion may be freely selected. Therefore, various different types of silver halide may be used; preferably, however, silver chlorobromide, silver bromo-iodide, or silver chloro-iodide, or a mixture thereof should be used.

The particle diameter of silver halide particles in the emulsion should be preferably 0.3~1.5μ. There is no particular limitation as to be crystalline form or crystal habit of the silver halide particles used. Particles having such a crystalline habit as cubic, octahedron, decatetrahedron, twin, or tabular can be conveniently used.

For preparation of the emulsion any of the following techniques may be employed: acid process, neutral process, alkaline process, or ammonia process. Also, the sequential mixing process, reverse mixing process, or simultaneous mixing process may be employed. Alternatively, the pAg controled double jet process or the conversion process may be employed to produce a multi-layered type emulsion.

In embodiment of the photographic material of the invention, it is possible to provide a high/sensitivity emulsion and a low-sensitivity emulsion in two separate layers, upper and lower, for the purpose of image gradation control. Or, the two emulsions may be coated in mixture.

Next, the antihalation layer according to the invention will be explained.

The antihalation layer absorbs any transmitted light which has passed through the silver halide emulsion layer, thereby preventing halation. According to the invention, the antihalation layer is formed nearer to the reflective support than the silver halide emulsion layer so that the light which has been transmitted through the silver halide emulsion layer is reflected by the reflective support, whereby the light is prevented from becoming again incident into the silver halide emulsion layer, it being thus possible to obtain good image sharpness.

Such antihalation layer is effective for the purpose of the invention insofar as it contains a material which can absorb a transmitted light as it reaches the layer and can thus prevent any reflected light incident into the silver halide emulsion layer. Such material is typically one which can absorb light of individual color regions, blue, green, and/or red, to which the silver halide emulsion layer is sensitive. Desirably, such material is liable to undergo reaction to become decolorized, or to be eluted from the photo-sensitive material to render same colorless, in the course of a series of processing stages, including color development, bleach-fix, and washing.

Various kinds of organic or inorganic compounds which exhibit such antihalation effects as above said may be used for the antihalation layer.

Organic compounds useful for the purpose of the invention include, for example, those represented individually by the following general formulas [I], [II], [II'], [II''].

General formula [I] is as follows:

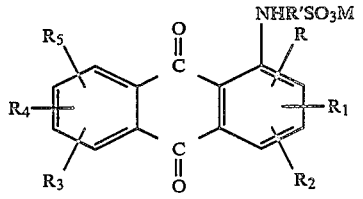

General formula [I]

In the formula, R, $R_1$, $R_2$, $R_3$, $R_4$, and $R_5$ each represent hydrogen atom; halogen atom e.g., chlorine atom, bromine atom, and fluorine atoms; hydroxy group; an alkyl group preferably those having 1~4 carbon atoms, such as for example methyl, ethyl, and propyl groups; an alkoxy group preferably those having 1~4 carbon atoms, such as methoxy, ethoxy, or propoxy groups; —$SO_3M$; or —$NHR'SO_3M$ group, in which R' represents an alkylene group e.g., a methylene or ethylene group, and M represents a cation, i.e., a hydrogen atom; an alkaline metal atom e.g., a sodium atom or a potassium atom; ammonium, or an organic ammonium salt e.g., pyridinium, piperidinium, triethyl ammonium, or triethanol amine.

Aforesaid individual groups include those having a substituent.

Typical examples of compounds represented b general formula [I] are shown below. However, it is to be understood that compounds expressed by said general formula [I] which are useful for the purpose of the invention are not limited by the exemplified compounds.

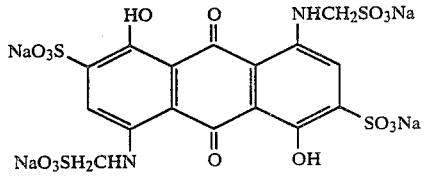

(I-1)

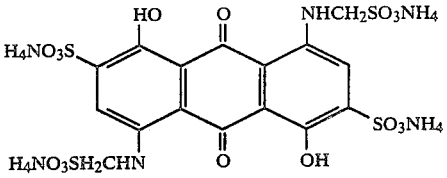

(I-2)

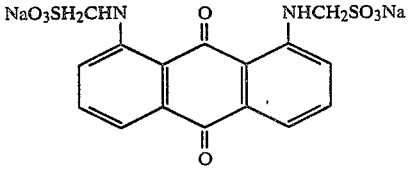

(I-3)

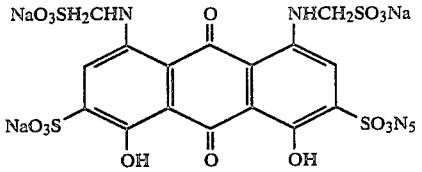

(I-4)

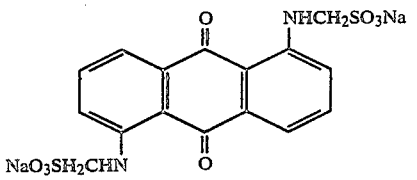

(I-5)

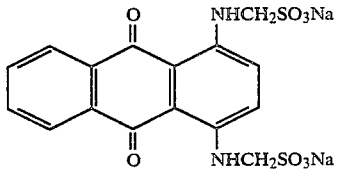

(I-6)

General formula [II] is

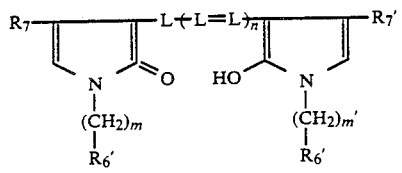

In the formula, $R_5$ and $R_6'$ each represent hydrogen atom, or an alkyl, aryl, or a heterocyclic group which may be substituted for; said alkyl group may be linear, branch, or cyclic, and preferably they have 1~4 carbon atoms as, for example, ethyl or β-sulfoethyl group.

The aryl groups are, by way of example, phenyl or naphthyl group, and may have a sulfo group, which may be in linkage with the corresponding aryl group through a bivalent organic group, for example, a phenyleneoxy, alkylene, alkyleneamino, or alkyleneoxy group, a carboxyl group, an alkyl group having 1~5 carbon atoms e.g., a methyl or ethyl group, an halogen atom e.g., a chlorine atom or bromine atom, an alkoxy group having 1~5 carbon atoms e.g., a methoxy or ethoxy group, or a phenoxy group. Among these aryl groups are, for example, 4-sulfophenyl group, 4-(δ-sulfobutyl) phenyl group, 3-sulfophenyl group, 2,5-disulfophenyl group, 3,5-disulfophenyl group, 6,8-disulfo-2-naphtyl group, 4,8-disulfo-2-naphtyl group, 3,5-dicarboxyphenyl group, 4-carboxyphenyl group, 4-(4-sulfophenoxy) phenyl group, 4-(2-sulfoethyl) phenyl group, 3-(sulfomethyl amino) phenyl group, and 4-(2-sulfoethoxy) phenyl group.

For the heterocyclic groups may be mentioned, for example, 2-(6-sulfo) benzthiazolyl group and 2-(6-sulfo) benzoxazolyl group. These groups may have a substituent group, such as halogen atom e.g., fluorine atom, chlorine atom, or bromine atom, an alkyl group (e.g., methyl or ethyl group), an aryl group e.g., phenyl group, a carboxyl group, sulfo group, hydroxy group, alkoxy group e.g., methoxy group, or an aryloxy group e.g., phenoxy group.

$R_7$ and $R_7'$ each represent hydroxy group; an alkoxy group preferably those having 1~4 carbon atoms; such as methoxy, ethoxy, isoproboxy, or n-butoxy group; substituted alkoxy groups, e.g., alkoxy groups having 1~4 carbon atoms that substituted by a halogen atom or an alkoxy group having not more than two carbon atoms e.g., β-chloroethoxy and β-methoxy-ethoxy groups; cyano group; trichloromethyl group, —COOR; —$CONHR_2$; —$NHCOR_6$, in which $R_6$ represents a hydrogen atom; an alkyl group having 1~4 carbon atoms, preferably 1~4 carbon atoms, or an aryl group, such as for example phenyl or naphtyl groups, the alkyl and aryl groups may have a sulfo group or carboxyl group as a substituent; an ureido group; an imino group; an amino group; a substituted amino group which are substituted by an alkyl group having 1~4 carbon atoms e.g., ethylamino, dimethylamino, diethylamono, and di-n-butylamino groups; or a cyclic amino group such as for example morpholeno, piperidino, or δ-piperazino group, or a group represented by

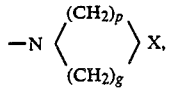

in which p, q represent integers of 1~2, and X represents an oxygen atom, a sulfur atom, or —$CH_2$—group.

A methyn group represented by L may be substituted by an alkyl group having 1~4 carbon atoms e.g., a methyl group, an ethyl group, an isopropyl group, or a tertiary butyl group, or by an aryl group e.g., a phenyl group, or a tolyl group.

In the sulfo, sulfoalkyl, and carboxyl groups contained in the heterocyclic group, at least one hydrogen atom may form a salt with an alkaline metal e.g., sodium or potassium, an alkaline earth metal e.g., calcium or magnesium, ammonia, or an organic base e.g., diethylamine, triethylamine, morpholine, pyridine, or piperidine. In the formula, n represents 0, 1, or 2; m and m' represent 0 or 1.

Typical examples of compounds represented by general formula [II] are shown below. It is understood, however, that compounds represented by the general formula [II] are not limited by the exemplified compounds.

The specific examples of such compounds are shown by specifying $R_6$, $R_6'$, $R_7$, $R_7'$, L, and n in general formula [II]. The general formula [II] compounds exemplified herein all refer to those in which m, m'=0.

Exemplified Compound List - 1
| | $R_6$ | $R_6'$ | $R_7$ | $R_7'$ | L | n |
|---|---|---|---|---|---|---|
| II - 1 | 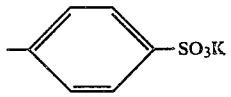 | 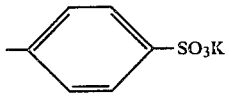 | —CN | —CN | =CH— | 0 |
| II - 2 | 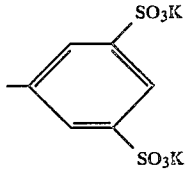 | 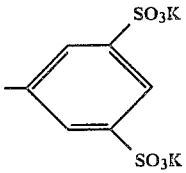 | —CN | —CN | =CH— | 1 |
| II - 3 | 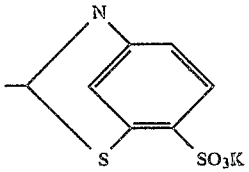 | 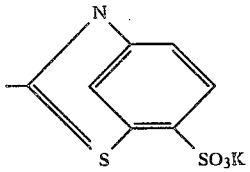 | —CN | —CN | =CH— | 1 |
| II - 4 | 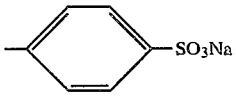 | 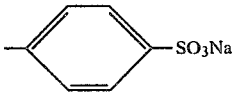 | —CN | —CN | =CH— | 0 |
| II - 5 | 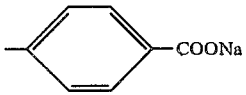 | 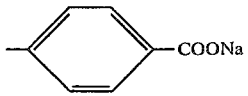 | —COONa | —COONa | =CH— | 0 |
| II - 6 | 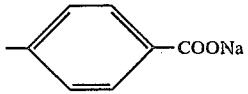 | 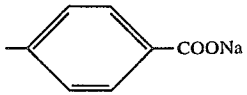 | —COO— 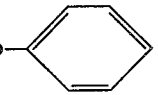 | —COO— 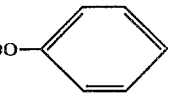 | =CH— | 0 |
| II - 7 | 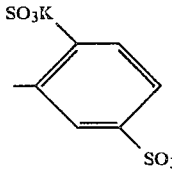 | 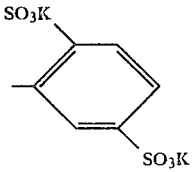 | —COOH | —COOH | =CH— | 0 |

-continued
Exemplified Compound List - 1
| | $R_6$ | $R_6'$ | $R_7$ | $R_7'$ | L | n |
|---|---|---|---|---|---|---|
| II - 8 | 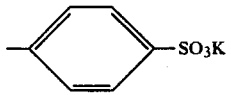 | 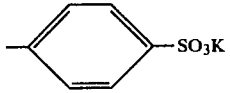 | —COOH | —COOH | =CH— | 1 |
| II - 9 | 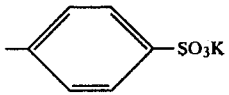 | 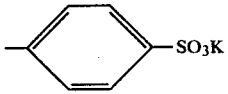 | —COOH | —COOH | | |
| II - 10 | 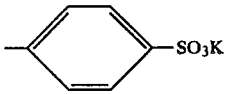 | 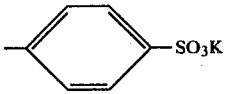 | $—COOC_2H_2$ | $—COOC_2H_2$ | =CH— | 2 |
| II - 11 | 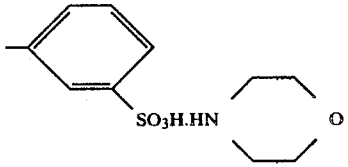 | 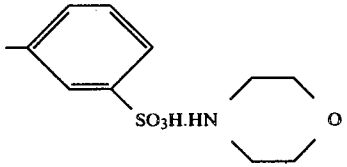 | —OH | —OH | =CH— | 2 |
| II - 12 | 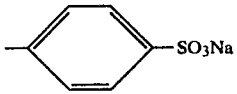 | 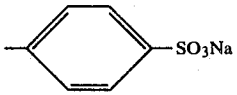 | $—OC_2H_5$ | $—OC_2H_5$ | =CH— | 2 |

Exemplified Compound List - 2
| | $R_6$ | $R_6'$ | $R_7$ | $R_7'$ | L | n |
|---|---|---|---|---|---|---|
| II - 13 | 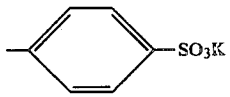 | 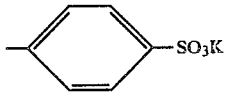 | $-COOH$ | $-COOH$ | $=CH-$ | 2 |
| II - 14 | 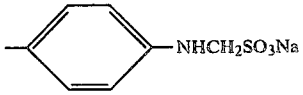 | 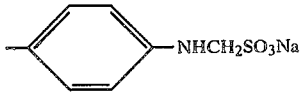 | $-COOH$ | $-COOH$ | $=CH-$ | 2 |
| II - 15 | 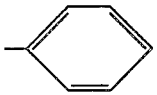 | 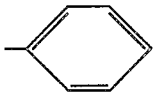 | 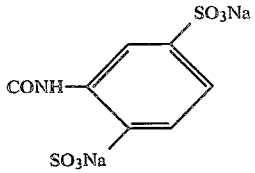 | 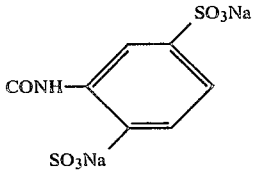 | $=CH-$ | 2 |
| II - 16 | 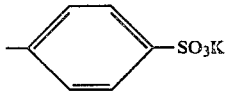 | 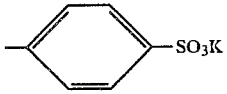 | $-CONH_2$ | $-CONH_2$ | $=CH-$ | 1 |
| II - 17 | 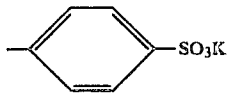 | 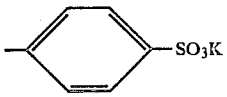 | 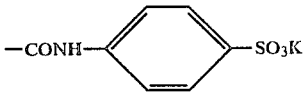 | 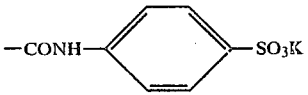 | $=CH-$ | 1 |
| II - 18 | 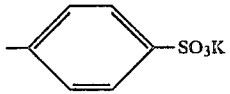 | 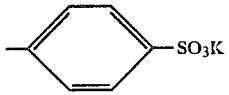 | $-NHCOCH_2$ | $-NHCOCH_2$ | $=CH-$ | 2 |
| II - 19 | 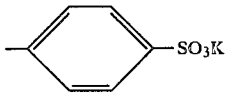 | 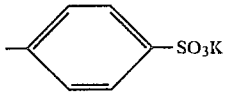 | $-CONH_2$ | $-CONH_2$ | $=CH-$ | 2 |

-continued
Exemplified Compound List - 2
| | $R_6$ | $R_6'$ | $R_7$ | $R_7'$ | L | n |
|---|---|---|---|---|---|---|
| II - 20 | 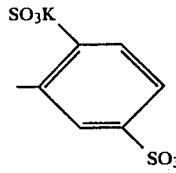 | 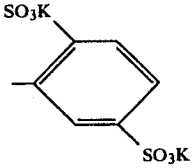 | —COOH | —COOH | =CH— | 1 |
| II - 21 | 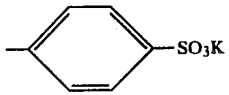 | 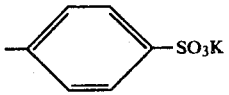 | —$NHCONH_2$ | —$NHCONH_2$ | =CH— | 1 |
| II - 22 | 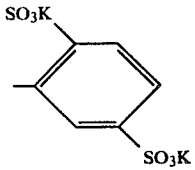 | 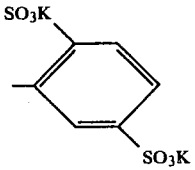 | —COOH | —COOH | =CH— | 1 |
| II - 23 | 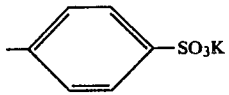 | 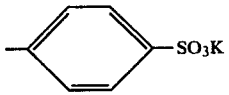 | —$COOC_2H_5$ | —$COOC_2H_5$ | =CH— | 1 |

Exemplified Compound List - 3
| | $R_6$ | $R_6'$ | $R_7$ | $R_7'$ | L | n |
|---|---|---|---|---|---|---|
| II - 24 | 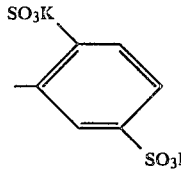 | 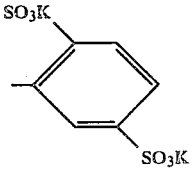 | $-OCH_2CH_2Cl$ | $-OCH_2CH_2Cl$ | =CH— | 1 (—Cl) |
| II - 25 | 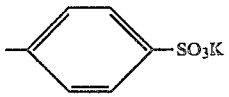 | 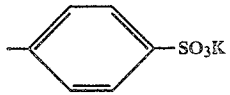 | $-N(C_4H_{9-n})_2$ | $-N(C_4H_{9-n})_2$ | =CH— | 2 |
| II - 26 | 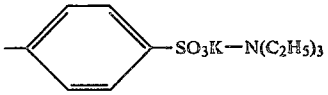 | 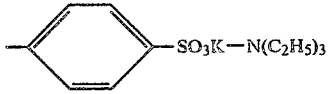 | $-NH_2$ | $-NH_2$ | =CH— | 2 |
| II - 27 | 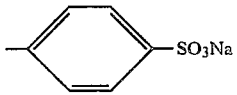 | 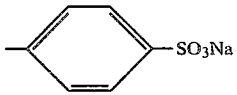 | 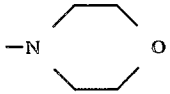 | 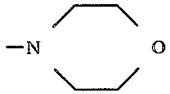 | =CH— | 2 |
| II - 28 | —H | —H | 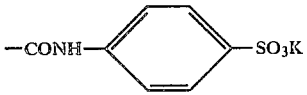 | 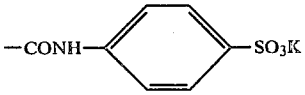 | =CH— | 1 |
| II - 29 | $-CH_2CH_2SO_3K$ | $-CH_2CH_2SO_3K$ | 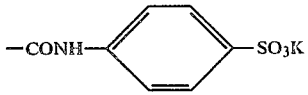 | 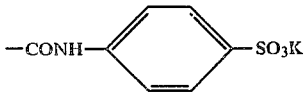 | =CH— | 1 |

General formula [II'] is

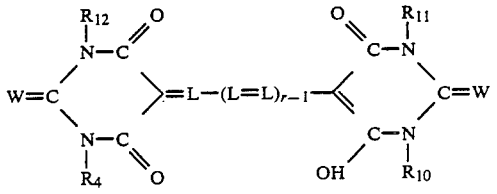

In the formula, r represents an integer of 1 to 3, W represents a sulfur atom, L represents a methine group, and $R_9$ through $R_{12}$ each represent hydrogen atom, an alkyl group, an aryl group, an aralkyl group, or a heterocyclic group, at least one of $R_9$ through $R_{12}$ being a substituent group other than a hydrogen atom.

For methine group represented by L may be mentioned those enumerated with reference to general formula [II].

For alkyl groups represented by $R_9$ through $R_{12}$ may be mentioned same alkyl groups as those enumerated for $R_6$ and $R_6'$ in general formula [II]. The alkyl groups may have a substituent group. Substituent groups useful for the purpose include, for example, various substituent group enumerated as such for introduction into the $R_6$ and $R_6'$ groups in general formula [II]; preferably, they are sulfo, carboxyl, hydroxy, alkoxycarbonyl, cyano, and sulfonyl groups.

Aryl groups represented by $R_9$ and $R_{12}$ are preferably phenyl groups For substituent groups which may be introduced into the phenyl groups are mentioned those enumerated as such for introduction into the $R_6$ and $R_6'$ groups in general formula [II]. It is desirable in this connection that at least one group selected from the group consisting of sulfo, carboxyl, and sulfamoyl groups is to be present on an aromatic nucleus.

Aralkyl groups represented by $R_9$ through $R_{12}$ are preferably benzyl or phenetyl groups. For substituent groups useful for introduction into individual nucleuses of such groups may be mentioned same substituents as those for aforesaid $R_9$ through $R_{12}$ aryl groups.

Heterocyclic groups represented by $R_9$ through $R_{12}$ include, for example, pyridyl and pyrimidyl. For substituent groups useful for introduction into their individual heterocycles may be mentioned same substituents as those enumerated for said $R_9$ through $R_{12}$ aryl groups.

Groups represented by $R_9$ through $R_{12}$ each are preferably an alkyl and an aryl group. Further, it is desired that at least one group selected from the group consisting of carboxyl, sulfo, and sulfamoyl groups is present within the molecules of barbituric and thiobarbituric acids represented by general formula [II']. Such group is preefrably symmetrical.

Typical examples of compounds represented by said general formula [II'] are shown below. It is understood, however, that general formula [II'] compounds are not limited by these examples.

Compound Examples

| | $R_9$ | $R_{10}$ | $R_{11}$ | $R_{12}$ | L | r | W |
|---|---|---|---|---|---|---|---|
| II'-1 | 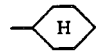 | | $-CH_2COOH$ | | =CH— | 1 | =O |
| II'-2 | $-C_2H_5$ | | $-CH_2COOH$ | | =CH— | 1 | =S |
| II'-3 | $-C_4H_9$-n | | $-CH_2COOH$ | | =CH— | 2 | =O |
| II'-4 | 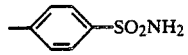 | | $-CH_2COOH$ | | =CH— | 2 | =O |
| II'-5 | $-C_4H_9$-n | | $-CH_2COOH$ | | =CH— | 2 | =S |
| II'-6 | $-C_4H_9$-n | | $-CH_2COOH$ | | =CH— | 3 | =S |
| II'-7 | 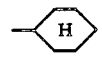 | | $-CH_2COOH$ | | =CH— | 3 | =S |

General formula [II''] is

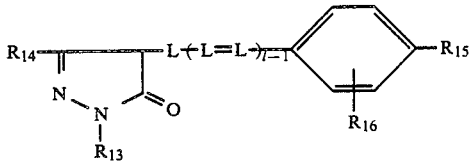

In the formula, l represents an integer of 1 or 2, L represents a methine group, and $R_{13}$ represents an alkyl group, an aryl group, or a heterocyclic group in the same sense as $R_6$ and $R_6'$ in general formula [II]. Preferably, $R_{13}$ is an alkyl or aryl group. It is desirable that the aryl group has at least one sulfo group.

$R_{14}$ and $R_{15}$ are groups into which all the substituent groups mentioned for $R_7$ and $R_7'$ in general formula [II] can be introduced. Preferably, they are selected from among an alkyl, carboxyl, alkoxycarbonyl, carbamoyl, ureide, acylamino, imino, and cyano groups. The alkyl group represented by $R_{14}$ may be linear, branch, or cyclic. Preferably it has 1~6 carbon atoms. It may be a hydroxy-, carboxy-, or sulfo-substituted alkyl group. Examples of such substituted groups are methyl, ethyl, iso-propyl, n-butyl, and hydroxyethyl groups.

An alkyl group contained as a substitutent in the alkoxy groups alkyl-substituted aminoalkyl group represented by $R_{14}$ and $R_{15}$ include, for example, methyl, ethyl, butyl, hydroxyalkyl e.g., hydroxyethyl, alkoxyalkyl e.g., β-ethoxyethyl, carboxyalkyl e.g., β-carboxyethyl, alkoxycarbonyl alkyl e.g., β-ethoxycarbonyl ethyl, cyanoalkyl e.g., β-cyanoethyl, and sulfoalkyl e.g., β-sulfoethyl, γ-sulfopropyl groups.

$R_{16}$ represents a hydrogen atom, an alkyl group, a chlorine atom, or an alkoxy group. The alkyl group is, for example, methyl or ethyl. The alkoxy group is, for example, methoxy or ethoxy.

Typical examples of compounds expressed by aforesaid general formula [II''] are given below. It is understood, however, that general formula [II''] compounds useful for the purpose of the invention are not limited by these examples.

Compound Examples

| | $R_{13}$ | $R_{14}$ | $R_{15}$ | $R_{16}$ | L | l |
|---|---|---|---|---|---|---|
| II"-1 | 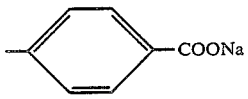 | $-C_2H_4OH$ | 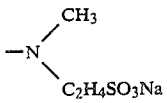 | — | =CH— | 1 |
| II"-2 | 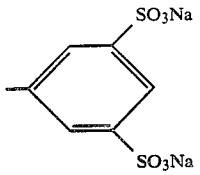 | $-COOCH_3$ | $-NHCH_3$ | — | =CH— | 1 |
| II"-3 | $-CH_2SO_3Na$ | 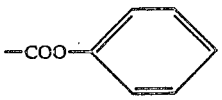 | 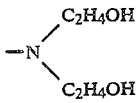 | — | =CH— | 1 |
| II"-4 | 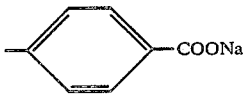 | $-COOH$ | 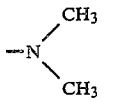 | — | =CH— | 2 |
| II"-5 | 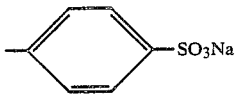 | $-CH_3$ | 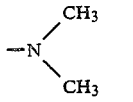 | — | =CH— | 1 |
| II"-6 | $-CH_2COONa$ | $-COOH$ | 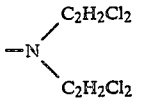 | — | =CH— | 1 |
| II"-7 | 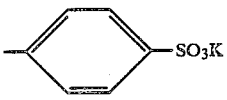 | 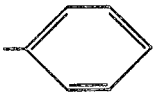 | 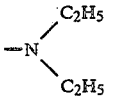 | — | =CH— | 1 |
| II"-8 | 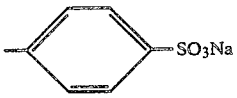 | $-NHCONH-$ 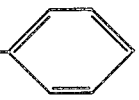 | 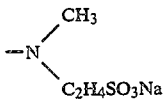 | — | =CH— | 1 |

Compounds of the foregoing general formulas [I], [II], [II'], or [II"] can be synthesized by various methods, such as those described in the specifications of U.S. Pat. Nos. 3,575,704, 3,247,127, 3,540,887, and 3,653,905, and Japanese Published Unexamined Patent Application Nos. 48-85130, 49-99620, 59-111640, 59-111641, and 59-170838.

Any such compound may be incorporated into a coating liquid for the antihalation layer in accordance with the invention after it is dissolved in a suitable solvent such as, for example, water, alcohol e.g., methanol, ethanol, or propanol, acetone, or Cellosolve, or a mixture thereof.

These compounds may be used in a combination of two or more kinds.

Such organic compound or compounds are incorporated into the antihalation layer as above said. For this purpose, if the compound is a water-soluble compound which is particularly likely to diffuse and migrate from the antihalation layer into other silver halide emulsion layer or layers, it may be caused to react with a polymer in order to lower such diffusion possibility, whereby such undesirable migration effect can be eliminated.

Various polymers useful for this purpose which function as a mordant may be mentioned from among those which combine with a compound to inhibit the diffusion of the latter. For example, polymers having secondary and tertiary amino groups, or a nitrogen-containing heterocyclic portion, or a quaternary cationic group, and which have a molecular weight of 5,000~200,000, more particularly 10,000~50,000 may be advantageously used.

Examples of these polymers include: vinylpyridine and vinylpyrinidium cation polymers as disclosed in the specifications of U.S. Pat. Nos. 2,548,564, 2,484,430, 3,148,061, and 3,756,814; polymer mordants crosslikable with gelatin or the like as disclosed in the specifications of U.S. Pat. Nos. 3,625,694, 3,859,096, and 4,128,538, and British Patent Nos. 1,277,453; water-based sol type mordants as disclosed in U.S. Pat. Nos. 3,958,995, 2,721,852, and 2,798,063, and Japanese Patent Publication Open to Public Inspection (hereinafter referred to as Japanese Patent O.P.I. Publication) Nos. 54-115228, 54-145529, and 54-126027; a water-insoluble mordant disclosed in the specification of U.S. Pat. No. 3,898,088; a reactive mordant capable of forming a covalent bond with a dye as disclosed in the specification of U.S. Pat. No. 4,168,976 (which corresponds to Japanese Patent O.P.I. Publication No. 54-137333); and moradants as disclosed in the specifications of U.S. Pat. Nos. 3,709,690, 3,788,855, 3,642,482, 3,488,706, 3,557,066, 3,271,147, and 3,271,148, and Japanese Patent O.P.I. Publication Nos. 50-71332, 53-30325, 52-155528, 53-125, and 53-1024.

In addition to the above, mordants described in U.S. Pat. Nos. 2,675,316 and 882,156 are mentioned as such.

Of these mordants, those which are unlikely to migrate from an antihalation layer to another layer are preferred. For example, as will be described hereinafter, mordants capable of crosslinking with a hydrophilic colloid, such as gelatin, water-insoluble mordants, and water-based sol, or latex dispersion, type mordants are preferably used.

Particularly preferred polymer mordants are shown below by way of example.

(1) A polymer having a quaternary ammonium group and also a group capable of forming a covalent bond with gelatin, such as, for example, an aldehyde group, a chloroalkanoyl group, a chloroalkyl group, a vinylsulfonyl group, a pydiniumpropionyl group, a vinylcarbonyl group, or an alkylsulfonoxy group. For example:

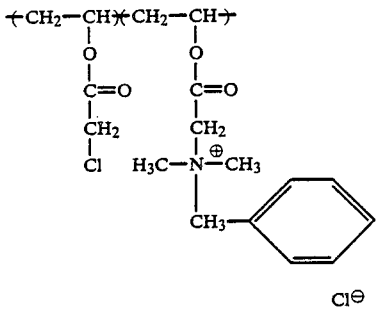

(2) A reaction product of a copolymer composed of a repeating unit of a monomer and a repeating unit of an unsaturated monomer of other ethylene type with a crosslinking agent, for example, alkane sulfonate, or bisallene sulfonate, represented by the following general formula [Ma]:

General formula [Ma]

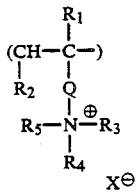

$R_1$: an alkyl group;
$R_2$: H, or an alkyl or aryl group;
Q: a bivalent group
$R_3$, $R_4$, $R_5$: H, or alkyl or aryl groups. At least two of the $R_3$ through $R_5$ may unit to form a heterocycle.
X: anion
(Said alkyl and/or aryl groups include substituted groups thereof.)

(3) A polymer expressed by the following general formula [Mb]:

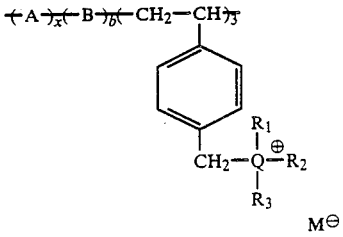

x: about 0.25~about 5 mol %
y: about 0~about 90 mol %
z: about 10~about 99 mol %
A: a monomer having at least two ethylene-type unsaturated bonds Also, inorganic compounds, such as colloidal silver, colloidal manganese, and the like, can be advantageously used as light absorbing materials for incorporation into an antihalation layer. These materials have good decoloring characteristics and, therefore, they can be effectively used when the invention is applied to a color photosensitive material. Colloidal silver, for example, gray colloidal silver, can be obtained by reducing silver nitrate in gelatin in the presence of a reducing agent, such as hydroquinone, phenydon, ascorbic acid, pyrogallol, or dextrin while it is kept alkaline tehrein, then neutralizing and cooling the resulting product to set the gelatin, and subsequently removing the reducing agent and unnecessary salts by the "noodle" washing method. Colloidal silver dispersions having uniform particles can be obtained by causing colloidal silver particles to be formed in the presence of an azaindene compound or mercapto compound in the process of reduction in alkaline condition.

Generally, such dispersions are preferably used in a proportional range of $10^{-3}$ g/m$^2$~1 g/m$^2$, more preferably $10^{-2}$ g/m$^2$~0.5 g/m$^2$, though such proportional range is not always applicable.

The silver halide color photographic materials according to the present invention preferably have a thickness of the layer(s), formed closer to the support than the silver halide emulsion layers are, less than 4 micrometers. In this case, the thickness of the layer(s) represents the thickness of the anti-halation layer formed on the support, or the total thickness of the anti-halation layer and another non-light-sensitive layer such as a first intermediate layer coated on the anti-halation layer as an aid layer. The total thickness is preferably less than 4 micrometers. Further, it is more preferable that the thickness is less than 3 microns and more than 1 micron. If the thickness is within the above-mentioned range, the rise of the minimum density ($D_{min}$) can be controlled without lowering the gamma 1 ($\gamma 1$) of the shadow part in the photographic characteristic curve, thereby allowing a high contrast in the shadow part and maintaining the whiteness in good condition. In addition, the dot reproducibility is significantly improved as a significant effect by keeping the thickness in the above-mentioned range.

If the thickness exceeds 4 microns, $\gamma 1$ is apt to lower and $D_{min}$ is apt to increase. Therefore, it is not preferable. On the contrary, if the thickness is less than 1 micron, the contrast in the shadow part is improved, however, some problems occurs when forming the layer.

The silver halide photographic material in accordance with the invention may be applied to a wide range of photographic materials, including black and white photographic materials, color photographic materials, and photocopying sensitive materials. For example, it is applicable to both reversal type and direct positive type photographic materials particularly to direct positive type color photographic material, on which direct positive images are formed by lightfogging.

As an example of a direct positive silver halide emulsion preferably used for the light-sensitive material of the present invention, an internal latent image silver halide emulsion is available. As the examples of such an emulsion, the following are available; a so-called conversion silver halide emulsion prepared in compliance with a method of conversion disclosed in U.S. Pat. No. 2,592,250; a silver halide emulsion, containing silver halide grains individually having chemically-sensitized core, disclosed in U.S. Pat. Nos./3,206,316, and No. 3,317,322; a silver halide emulsion, containing silver halide grains individually internally having a multivalent metallic ion, U.S. Pat. Nos. 3,271,157, No. 3,447,927 and No. 3,531,291; a silver halide emulsion having a doping agent and silver halide grains whose individual surface being slightly chemically sensitized, disclosed in U.S. Pat. No. 3,761,276; a so-called core-shell silver halide emulsion prepared in compliance with a process to form a multi-layered grain structure, disclosed in Japanese Patent Publications Open to Public Inspection No. 8524/1975, No. 38525/1975, and No. 2408/1978 (hereinafter referred to as Japanese Patent O.P.I. Publications); silver halide emulsions disclosed in Japanese Patent O.P.I. Publication No. 156614/1977, No. 127549/1980 and No. 79940/1982 and the like.

In particular, the internal latent image silver halide grain is preferably a multi-layered grain.

Such silver halide can be prepared with a method indentical to that of conventional multi-layered silver halide grain. The examples of such a method are disclosed, for example, in Japanese Patent O.P.I. Publication No. 8524/1975, No. 38525/1975, No. 60222/1978, No. 1524/1980 and U.S. Pat. No. 3,206,313: a method, wherein silver chloride grains are formed at first, then converted into silver bromide grains by adding bromide, whereby a layer is formed on individual agains by adding a halide to silver nitrate; a method, wherein silver iodo-bromide grains are formed under the conditions with a smaller amount of excess halogen, whereby silver chloride then silver bromide are sequentially laminated on the individual silver iode-bromide grains.

As an interior composition of an individual multilayered or core-shell silver halide grain, a silver iodobromo-chloride having a large silver bromide content (60–100 mol %) is preferred. As a composition of silver halide laminated around the core, silver chloro-bromide is preferable, and it is desirable that the silver chlorobromide has a large silver chloride content (more than 70 mol %) in view of better developability.

As for a silver halide grain size, a size of 0.2 to 1.7* is useful. Further, when a high contrast is required, grains of a smaller grain size distribution are preferable and, when a low contrast is required, grains having a large grain size distribution are preferred.

With silver halide grains used for these purposes, the crystal configulation and crystal habit are not specifically limited. As for the crystal habit, similar grains of cubic crystal, octahedron, tetradecahedron, twinned crystal, or tabular crystal is preferably used.

As for a process for preparing the emulsion used for the invention, any of an acid process, neutral process, alkaline process, ammonium process and others may be employed. Further, any of the normal precipitation method, reverse precipitation method and double-jet precipitation method may be employed. Additionally, the pAg control double-jet method is also usable. Otherwise, a multi-layered grain type emulsion prepared by the conversion method may be used.

For the purpose of application to color photographic materials, the photographic material of the invention may be constructed as a photographic material having, in addition to an antihalation layer, a silver halide emulsion layer containing a yellow coupler layer, a magenta coupler layer, and a cyan coupler layer having a spectral sensitivity different each other. The order of these emulsion layers may be arbalrarily determined, however, the object of enhancing image sharpness can be satisfactorily accomplished by using the following arrangement for the formation of an emulsion layer containing the individual couplers. That is, an emulsion layer having, in order of proximity to a support an emulsion layer containing the cyan coupler, an emulsion layer containing the magenta coupler, and an emulsion layer containing the yellow coupler. The reason why the yellow coupler layer is formed on the topmost side, and not nearmost to the base as hithertofore is that the effect of any deterioration in yellow coupler sensitivity upon human visible sensation can be minimized by such arrangement, and that any unfavorable effect of such deterioration on image sharpness can thus be restrained. Whilst, by forming the cyan coupler containing layer on the lowermost side it is possible to allow any light entering from the back of the photosensitive material to be absorbed by the antihalation layer so that any image deterioration in the cyan coupler layer is prevented, it being thus possible to maintain good image sharpness.

For incorporation into said individual color sensitive layers, various types of couplers may be mentioned as useful. Referring first to yellow dye forming couplers, benzoyl acetoanilide type couplers, pivaloyl acetoanilide type couplers, and two-equivalent type yellow couplers in which a carbon atom at a coupling position is replaced by a so-called split-off group capable of being splitted off during coupling reaction are all useful.

For use as a magenta dye forming coupler, 5-pyrazolone couplers, pyrazolotriazole couplers, pyrazolinobenzoimidazole couplers, indazolone couplers, and two equivalent type magenta couplers having a split-off group are all useful.

For use as a cyan dye forming coupler, phemolic couplers, naphthol couplers, pyrazoquinazolone couplers, and two equivalent type cyan couplers having a split-off group are all useful.

These dye forming copulers may be selectively used as desired and are not subject to any particular limitation as to the manner of use, quantity for use, etc.

In order to prevent discoloration of a dye image due to short-wave active light rays, a ultraviolet light absorber may be used. For use as such absorber can be mentioned, for example, thiazolidone, benzotriazole, acrylonitrile, and benzophenone compounds. More particularly, Tinuvin PS, Tinuvin 120, Tinuvin 320, Tinuvin 326, Tinuvin 327, and Tinuvin 328 (all of which are products of Chiba Geigy) may be advantageously used either alone or in combination.

Where this invention is applied to a multi-layer color photosensitive material, the photographic material may comprise an antihalation layer, aforesaid red, green, and blue sensitive layers, and a yellow filter layer, and if desired, a protective layer and an intermediate gelatin layer.

For the purpose of carrying out the invention, various kinds of photographic additives may be added to the silver halide emulsion used. For example, the following may be used as optical sensitizing agents: cyanines, merocyanines, trinuclear or quandnuclear cyanines, styryls, holopolarcyanines, hemicyanines, oxonols, and hemioxonols.

A conventional stabilizer, such as for example a compound having an azaindene cycle, or a heterocyclic compound having a mercapto group, may be incorporated into the emulsion.

A preferred compound having an azaindene ring is, for example, 4-hydroxy-6-methyl-1, 3, 3a, 7-tetrazaindene. Examples of heterocyclic compounds capable of forming a bond with a mercapto group and having a nitrogen content are: pyrazole, 1, 2, 4-triazole, 1, 2, 3-triazole, 1, 2, 3-thiadiazole, 1, 2, 3-thiadiazole, 1, 2, 4-thiadiazole, 1, 2, 5-thiadiazole, 1, 2, 3, 4-tetrazole, pyritadine, 1, 2, 3-triadine, 1, 2, 4-triadine, 1, 2, 5-triadine rings, and condensedring compounds in which two or three of such rings are condensed, such as triazolotriazole, diazaindene, triazaindene, and pentazaindene rings; also phthaladinone and indazole rings. More particularly, 1-phenyl-5-mercaptotetrazole is preferred.

In addition, according to a specified purpose, a wetting agent may be used. For example, dihydroxyalkane is useful as such. For the purpose of film property improvement, a waterdispersible particulate polymer material is useful which is obtained through emulsion polymerization, for example, of a copolymer of alkylacrylate or alkylmethacrylate with acrylic acid or methacrylic acid, a styrene-maleic acid copolymer, or a styrene maleic anhydride-half alkyl ester copolymer. For use as a coating aid may be mentioned, for example, saponin, polyethylene glycol, and lauryl ether. Other photographic additives, such as gelatin plasticizer, surface active agent, ultraviolet light absorber, pH adjusting agent, antioxidant, antistatic agent, thickening agent, graininess improver, dyestuff, mordant, brightening agent, developing speed adjuster, matting agent, and irradiation preventing dye, may be used as desired.

According to the invention, it is preferable that a compound represented by the following formula (I) is contained in at least one of the photographic structural layers, favorably in an anti-halation layer or an layer adjacent to the anti-halation layer. Such a compound can function as an antistain agent.

The formula (I) is as follows:

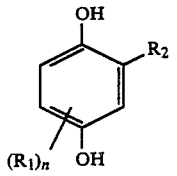

In this formula, $R_1$ and $R_2$ independently represent a hydrogen atom, or alkyl group having less than 5 carbon atoms, and n is, preferably, 1 or 3.

The following compounds represented by (A) through (H) are preferable as typical examples of a compound expressed by the above formula [I]. However, the useful compounds according to the invention are not limited only to these examples.

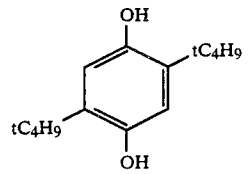

(A)

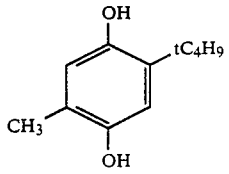

(B)

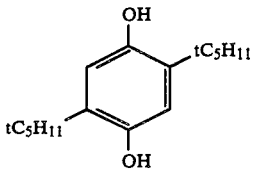

(C)

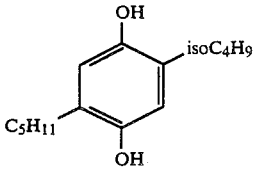

(D)

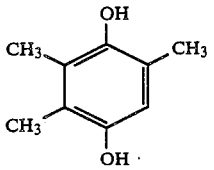

(E)

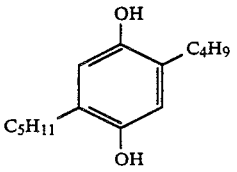

(F)

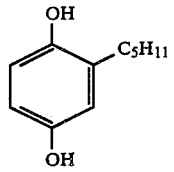

(G)

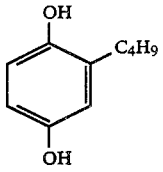

(H)

When such a compound is added to at least one of photographic structural layers, the amount of addition is, favorably 0.001–0.50 g/m*, and more favorably, 0.005–0.20 g/m*. Additionally, any of the above-mentioned compounds can be independently used, or more than two of them, arbitrarily selected, can be combinedly used. Furthermore, such a compound represented by the formula [I] can be used combinedly with a kinon derivative having more than 5 carbon atoms. However, in any case, even in the case of a mixture, the entire amount used is favorably within the range of 0.001 to 0.50 g/m*.

And photographic structural layers are a plurality of layers which include light-sensitive layers, as well as nonlight-sensitive layers at least including an anti-halation layer. The color-sensitive layers comprise a silver halide emulsion layer containing a cyan coupler, a silver halide emulsion layer containing a magenta coupler, a silver halide emulsion layer containing and a yellow coupler. At the same time, the non-light-sensitive layers comprise an anti-halation layer, as well as layers, being formed in accordance with a specific requirement, such as intermedate layers and a layer protecting emulsion layers. Any of the above-mentioned compounds is incorporated into at least one of these photographic structural layers, but the processing conditions such as timing and a method of addition are not specifically limited. By incorporating any of the above-mentioned compounds into at least one of the photographic structural layers, stains of developed image are reduced and, as a result, a light-sensitive material featuring excellent reservation of white portion and excellent color reproducibility can be obtained. This is because, by adding any of such compounds, a minimum density of a developed photograph can be restrained at a low level, and the toe portion in the characteristic curve can be well maintained clear-cut, and the contrast of shadow portion can be highly preserved.

An amount for use of the above compound is preferably within a range of 0.001 to 0.50 g/m$^2$. The smaller the amount is than this range, the above effects slowly diminishes. In contrast, the larger the amount is, the lower the contrast of shadow portion become in spite of more clear-cut toe. Totally judging, the total amount of the compound is, therefore, preferably within the above mentioned range.

The silver halide photographic material of the invention may contain, according to a specific purpose, a suitable gelatin (including oxidizing treated gelatin) and/or a derivative thereof in the form of a hydrophilic colloidal layer. Preferred gelatin derivatives are, for example, acylated gelatin, guanidylated gelatin, carbamylated gelatin, cyanoethanolated gelatin, and esterigied gelatin. Such kinds of gelatin may be used for nonsensitive layers, such as antihalation layer and the like. For example, where a layer is formed as a non-light-sensitive layer at a side opposite from the emulsion layer, such gelatin is used for the non-light-sensitive layer.

In the silver halide photographic material according to the invention, the hydrophilic colloidal layer may contain, in addition to gelatin, another kind of hydrophilic binder.

Such hydrophilic binder may be added to the emulsion layer and/or other component layer, such as intermediate layer, protective layer, filter layer, and matt backing layer, according to specific purposes. Further, a suitable plasticizer, lubricant or the like may be incorporated into said hydrophilic binder as desired. Such gelatins and/or binders may be used in non-light-sensitive layers including the antihalation layer in same manner as mentioned above. The component photographic layers of the photographic material in accordance with the invention may be hardened with a suitable hardening agent. For such purpose, chromic salt, zirconate, halotriazine, vinylsulfone, and acryloyl hardening agents may be used.

The silver halide photographic material of the invention may, as already mentioned, have various photographic layers, such as filter layer, intermediate layer, subbing layer, and backing layer, formed by coating as required. Various coating methods may be employed, including dip coating, air doctor coating, extrusion coating, slide hopper coating, and curtain flow coating.

Where the present invention is applied to a reversal type silver halide photosensitive material, development and other processing may be carried out by employing various techniques conventionally used in the processing of the reversal type.

When the photographic material of the invention is used, for example, as a silver halide photographic material of the internal latent image type in order to form a direct positive image, the main stages involved are generally carried out in the following manner: fogging treatment is given after image exposure, then surface development is effected, or surface development is effected while said fogging treatment is being given. Said fogging treatment may be carried out by giving an overall uniform exposure or by using a fogging agent. In this case, it is desirable that said overall uniform exposure should be effected in such a way that the image exposed silver halide photographic material of the internal latent image type is immersed in a developing bath or other aqueous solution or wetted before it is subjected to overall uniform exposure.

For this purpose, any source of light may be used insofar as the light is within a photosensitive wavelength region applicable to the silver halide photographic material of the internal latent image type. A high-intensity light ray, such as flash light may be applied for a short duration of time, or a weak light ray may be applied for a relatively long time. The time for overall uniform exposure may be widely varied according to the composition of the photographic material, developing conditions, and the type of the light source, to ensure that a best positive iamge can be finally obtained. A wide variety of compounds may be used for said fogging agent. Such fogging agent is effective only if it is present during the stage of development. For example, it may be present in the internal latent image type silver halide photographic material, in its silver halide emulsion layer, or in the developing solution, or in a processing solution used prior to development. Preferably, it should be present in the photosensitive material (and more particularly in the silver halide emulsion layer thereof). The usage of such agent may be widely varied according to specific purposes. If it is admixed into the silver halide emulsion layer, a preferred quantity for use is 1~1500 mg, more preferably 10~1000 mg, per mol of silver halide. If it is admixed into a processing solution, such as developing solution, a preferred quantity for use is 0.01~5 g/l, more preferably 0.08~0.15 g/l. Compounds useful as such fogging, agent include, for example, hydrazines mentioned in U.S. Pat. Nos. 2,563,785 and 2,588,982, a hydrazine or hydrazone compound mentioned in U.S. Pat. No. 3,227,552, heterocyclic quaternary compounds mentioned in U.S. Pat. Nos. 3,615,615, 3,718,470, 3,719,494, 3,734,738, and 3,759,901, and acylhydradinophenyl thioureas mentioned in U.S. Pat. No. 4,030,925. These fogging agents may be used either alone or in combination. For example, in Research Disclosure No. 15162, there is a mention that a non-adsorptive type fogging agent is used in combination with an adsorptive type fogging agent. This can be effectively applied to the invention.

Examples of useful fogging agents are: hydrazine hydrochloride, phenylhydrazine hydrochloride, 4-methyl phenylhydrazine hydrochloride, 1-formyl-2-(4-methylphenyl) hydrazine, 1-acetyl-2-phenylhydrazine, 1-acetyl-2-(acetoamidophenyl) hydrazine, 1-methylsulfonyl-2-phenylhydrazine, 1-benzoyl-2-phenylhydrazine, 1-methylsulfonyl-2-(3-phenylsulfon amidophenyl) hydrazine, and formaldehyde phenylhydrazine.

When the invention is applied to a silver halide photosensitive material of the internal latent image type as above said, a direct positive image is created by subjecting the photosensitive material to overall exposure after image exposure or developing same in the presence of a fogging agent. For development of the photographic material, any desired method may be employed, but preferably surface development techniques should be employed. The term "surface development technique" means that the silver halide emulsion is treated with a developing solution which virtually contains no silver halide solvent.

For the purpose of carrying out the present invention, an exposed silver halide photosensitive material is developed and processed with a treating solution having a fixing ability, whereby a positive image (developed image) corresponding to an original image can be produced.

EXAMPLES

The following examples are given to further illustrate the present invention. It is to be understood, however, that the invention is not limited by these examples.

EXAMPLE 1

This example represents an instance in which the invention was applied to a direct positive color photographic paper.

Individual emulsions were prepared as follows to produce silver halide photographic material specimens.

Preparation of Emulsion S 750 ml of 2.0% inactive gelatin liquid were kept at 50° C. The following A1 solution and B solution were added simultaneously to the gelatin liquid under stirring by pouring same thereinto over 3 min. After ripening for 25 min., excess salt was removed by a precipitation washing method. Subsequently, redispersion was effected and then C1 solution and C2 solution were added. Ten minutes later, excess water-soluble salt was again removed. A small amount of gelatin was added to disperse silver halide grains.

Preparation of Emulsion L 750 ml of 1.5% inactive gelatin liquid was kept at 60° C. The following A2 solution and B solution were added simultaneously to the gelatin liquid under stirring by pouring same thereinto over 15 min. After ripening for 40 min. excess salt was removed by the precipitation washing method. Subsequently, redispersion was effected and 10 mg of sodium thriasulfate was added; then C2 solution and D2 solution were added. Ten minutes later, excess water-soluble salt was again removed. A small amount of gelatin was added to disperse silver halide particles.

Preparation of Emulsion M 750 ml of 2.0% inactive gelatin liquid was kept at 50° C. The following A3 solution and B solution were added simultaneously to the gelatin liquid under stirring by pouring same thereinto over 5 min. After ripening for 25 min., excess salt was removed by the precipitation washing method. Subsequently, redispersion was effected and C1 solution and D2 solution were added. Ten minutes later, excess water-soluble salt was again removed. A small amount of gelatin was added to disperse silver halide particles.

| | | | |
|---|---|---|---|
| A1 solution | | | |
| Pure water | 2000 | ml | |
| NaCl | 35 | g | (60 mol %) |
| $NH_4Br$ | 109.6 | g | (80 mol %) |
| KI | 0.8 | g | (0.5 mol %) |
| A2 solution | | | |
| Pure water | 1000 | ml | |
| NaCl | 26.3 | g | (103 mol %) |
| $NH_4Br$ | 109.6 | g | (80 mol %) |
| KI | 0.8 | g | (0.5 mol %) |

-continued

| | | | |
|---|---|---|---|
| A3 solution | | | |
| Pure water | 1000 | ml | |
| NaC | 38.8 | g | |
| KBr | 12 | g | |
| B solution | | | |
| Pure water | 1200 | ml | |
| $AgNO_3$ | 170 | g | |
| C1 solution | | | |
| Pure water | 1000 | ml | |
| NaCl | 60 | g | (103 mol %) |
| $NH_4Br$ | 6.9 | g | (0.5 mol %) |
| C2 solution | | | |
| Pure water | 1000 | ml | |
| NaCl | 31.6 | g | |
| D1 solution | | | |
| Pure water | 1000 | ml | |
| $AgNO_3$ | 70 | g | |
| D2 solution | | | |
| Pure water | 1000 | ml | |
| $AgNO_3$ | 80 | g | |

Sensitizing dyes and couplers were added to the foregoing three kinds of emulsions. In manner is described below, the resulting emulsions were coated on supports A~D shown in Table 1, and thus a multi-layer color photographic material was produced.

Antihalation Layer (first layer)

A 2.6% gelatin solution containing a gray colloidal silver, obtained by reduction in the presence of a weak alkaline reducing agent provided that the weak reducing agent was removed by noodle washing method after neutralization a surface active agent [S-1], and a hardening agent [H-3], were prepared. The gelatin solution was coated so that the coating weight of the colloidal silver was 0.12 g/m$^2$ and the gelatin was 0.9 g/m$^2$.

First Intermediate Layer (second layer)

A gelatin solution containing a surface active agent [S-2] and a hardening agent [H-2] was prepared. Coating was made so that the coating weight of gelatin was 0.9 g/m$^2$.

Red Sensitive Emulsion Layer (third layer)

To both the emulsion S and the emulsion M were added sensitizing dyes [D-3], [D-4], stabilizers [T-1], [T-2], a surface active agent [S-2], and a protect-dispersed coupler solution containing dibutylterephthalate, ethyl acetate, a surface active agent [S-2], 2,5-dioctylhydroquinone, and cyan couplers [CC-1] and [CC-2].

Gelatin was added so that the emulsion M and S were in a mixture ratio of 4:6 (weight ratio).

Second Intermediate Layer (fourth layer)

A gelatin solution containing a protect-dispersed solution containing dioctylphthalate, a 2,5-dioctylhydroquinone UV light absorber "Tinuvin 328" (a product of Chiba Geigy) was prepared. Coating was effected so that the coating weight of "Tinuvin" was 0.15 g/m$^2$.

Green Sensitive Emulsion Layer (fifth layer)

To both emulsion S and emulsion M were added a sensitizing dye [D-2], stabilizers [T-1], [T-2], a surface active agent [S-2], and a protect-dispersed coupler solution containing dibutylphthalate, ethyl acetate, 2,5-dioctylhydroquinone, a surface active agent [S-1], a magenta coupler [MC-1].

Gelatin was added and then a hardening agent [H-1] was added. Coating was effected so that the emulsion M and the emulsion S stand in a ratio of 4:6 (weight ratio).

Third Intermediate Layer (sixth layer)

Coating was effected using same recipe as that for the second intermediate layer so that the coating weight of "Tinuvin 328" was 0.2 g/m$^2$.

Yellow Filter Layer (seventh layer)

A yellow colloidal silver prepared by reduction in the presence of an alkaline weak reducing agent, provided that after neutralization, the weak reducing agent was removed from the emulsion, was added with dispersion of dioctylphthalate containing ethyl acetate, a surface active agent [S-1], a 2,5-dioctylhydroquinone, a surface active agent [S-2], and a hardening agent [H-1]. Coating was effected so that the coating weight of colloidal silver takeup was 0.15 g/m$^2$.

Fourth Intermediate Emulsion Layer (eighth layer)

Same as the second intermediate layer so that the coating weight of Tinuvin was 0.15 g/m$^2$.

Blue Sensitive Emulsion Layer (ninth layer)

To both emulsion layer L and emulsion layer M were added a sensitizing dye [D-1], stabilizers [T-1] and [T-3], a surface active agent [S-2], and a protect-dispersed coupler solution containing dibutylphthalate, ethyl acetate, 2,5-dioctylhydroquinone, a surface active agent [S-1], and a yellow coupler [YC-1].

Gelatin was added, and then a hardening agent [H-1] was added. Coating was effected so that the emulsions L and M were in the ratio of 5:5 (weight ratio).

Fifth Intermediate Layer (tenth layer)

Coating was effected using same recipe as that for the second intermediate layer so that the coating weight of "Tinuvin 328" was 0.35 g/m$^2$.

Protective Layer (eleventh layer)

Coating was effected with a gelatin solution containing colloidal silica, a coating aid [S-2], hardening agents [H-2], [H-3] so that the coating weight of gelatin was 1.0 g/m$^2$.

Compounds used for aforesaid individual layers are as follows:

(D-1)

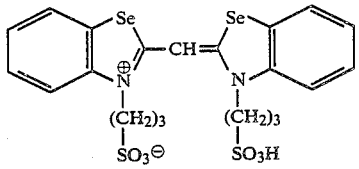

(D-2)

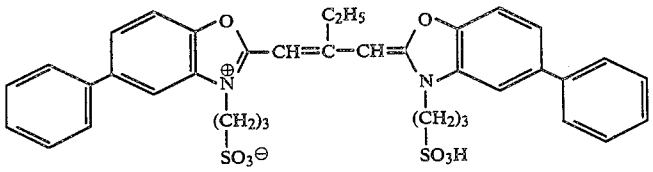

(D-3)

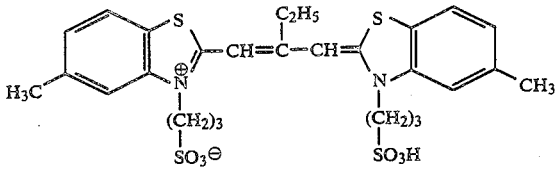

(D-4)

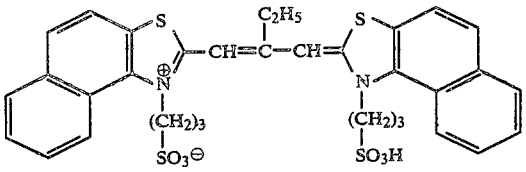

(T-1)

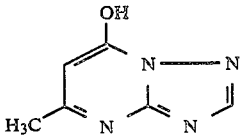

(T-2)

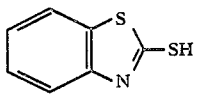

-continued
(T-3)
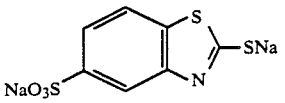
(S-1)
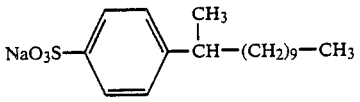
(S-2)
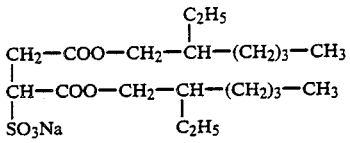
(H-1)
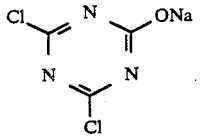
(H-2)
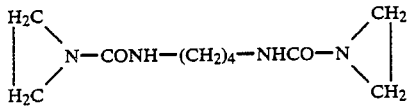
(H-3)
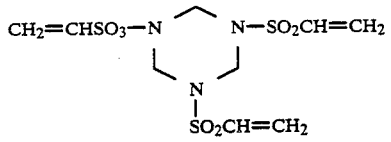
(YC-1)
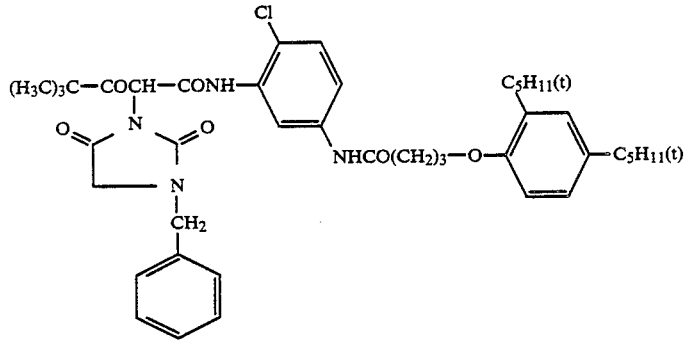
(MC-1)
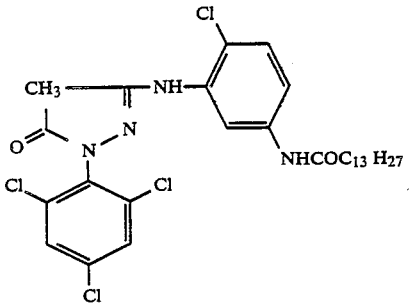
(CC-1)
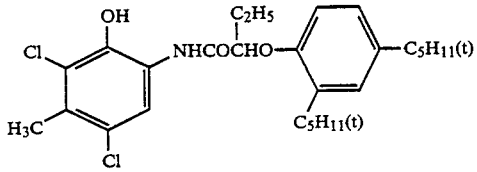

-continued

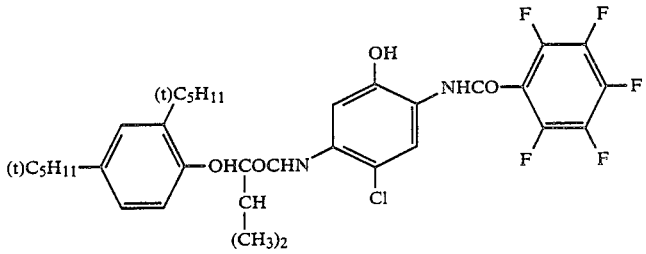

(CC-2)

A sample having a first layer as an antihalation layer and a second layer formed thereon, as above mentioned, was prepared. For the purpose of comparison, a reference sample having neither such first layer nor such second layer was prepared. Both samples were coated and dried, and photographic materials, direct positive color photographic paper sheets, were obtained. These materials were evaluated in respect of image sharpness in the following manner.

On each direct positive color photographic paper obtained was placed a three line/mm rectangular chart, density range D=1.5, in close contact relation. Exposure was made to a color balance of gray. Then development was made. FIG. 1 schematically shows the original rectangular chart, designated by reference character C, and reproduced chart after exposure and development, designated by reference character $C_1$. The density of the reproduced rectangular chart (designated by reference character $B_1$) corresponding to the amount of light which gives a solid color density of 1.5, to 0.1 line/mm of the original, designated by reference character B, was measured by Sakura Densitometer PDM-5 (made by Konishiroku Photo Industry Co.). Comparison in sharpness was made on the basis of the ratio of the density of the reproduced chart $C_1$ to the solid density, that is, $D_1/1.5$.

The greater the density ratio i.e., the closer to 1.0, the closer the density is to the original chart density, that is, higher in sharpness.

It is to be noted that density evaluation was made with respect to red density or a layer nearest to the support.

In this example, steps involved in development were as follows:

Steps Involved (processing temperatures and time)

| | | |
|---|---|---|
| [1] Steeping (color developing solution) | 38° C. | 8 sec |
| [2] Fog exposure | | 10 sec |
| [3] Color development | 38° C. | 2 min |
| [4] Bleach/fix | 35° C. | 60 sec |
| [5] Stabilization processing | 25~30° C. | 1 min 30 sec |
| [6] Drying | 75~80° C. | 1 min |

Compositions of Processing Solutions
(Color Developing Solution)

| | |
|---|---|
| Benzyl alcohol | 10 ml |
| Ethylene glycol | 15 ml |
| Potassium sulfite | 2.0 g |
| Potassium bromide | 1.5 g |

-continued

| | |
|---|---|
| Sodium chloride | 0.2 g |
| Potassium carbonate | 30.0 g |
| Hydroxylamine sulfate | 3.0 g |
| Polyphosphate (TPPS) | 2.5 g |
| 3-methyl-4-amino-N-ethyl-N-(β-mehanesulfone amide ethyl)-anilline sulfate | 5.5 g |
| Fluorescent brightener (4, 4'-diaminostylbenz sulfonic acid derivative) | 1.0 g |
| Potassium hydroxide | 2.0 g |

Water is added to total quantity of 1 l, with pH adjusted to 10.20.

Bleach/Fix Solution

| | |
|---|---|
| Ethylenediamine tetra-acetic acid ferric ammonium dihydrate | 60 g |
| Ethylenediamine tetra-acetic acid | 3 g |
| Ammonium thiosulfate (70% solution) | 100 ml |
| Ammonium sulfite (40% solution) | 27.5 ml |

The pH of the solution was adjusted to 6.5 with potassium carbonate or glacial acetic acid. Water was added to total quantity of 1 l.

Stabilization Processing Solution

| | |
|---|---|
| 5-chloro-2-methyl-4-isothiazoline-3-on | 1.0 g |
| Ethylene glycol | 10 g |
| 1-hydroxyethylidene-1,1'-diphosphonic acid | 2.5 g |
| Bismuth chloride | 0.2 g |
| Magnesium chloride | 0.1 g |
| Ammonium hydroxide (28% aqueous solution) | 2.0 g |
| Sodium nitrilotriacetate | 1.0 g |

Water is added to total quantity of 1 l and the pH of the solution was adjusted to 7.0 with ammonium hydroxide or sulfuric acid.

In Table 1 are shown respective constructions of the supports A~D used, and density ratio measurements with respect to those having first and second layers and those having no such layers. The presence or absence of first and second layers is indicated as "with antihalation layer" or "without antihalation layer". For each individual support, total thickness, and respective thickness values of white polyethylene layer, inner paper layer, and back-side polyethylene layer are shown. Transmission density values are also shown. In all cases, thickness is given in μm (micrometer).

TABLE 1

| Support | A | B | C | D |
|---|---|---|---|---|
| Thickness | | | | |
| Total | 80 | 100 | 135 | 230 |
| White polyethylene layer° | 21 | 25 | 25 | 34 |

TABLE 1-continued

| Support | A | | B | | C | | D | |
|---|---|---|---|---|---|---|---|---|
| Paper layer | 39 | | 54 | | 89 | | 166 | |
| Backside polyethylene layer | 20 | | 21 | | 21 | | 30 | |
| Transmission density | 0.54 | | 0.61 | | 0.72 | | 1.01 | |
| Antihalation layer | With | Without | With | Without | With | Without | With | Without |
| Density ratio | 0.66 | 0.18 | 0.70 | 0.30 | 0.74 | 0.41 | 0.77 | 0.70 |
| Invention/reference | Invention | Reference | Invention | Reference | Invention | Reference | Reference | Reference |

*White polyethylene layer contains 10 wt % of titanium oxide.

As may be understood from Table 1, if the transmission density of a support is low, no satisfactory density ratio can be obtained unless an antihalation layer is provided (see data for bases A, B, C without antihalation layer). In contrast to this, if an antihalation layer is provided, considerable improvement is obtainable in density ratio to a value very close to the transmission density of 1.01 of support D (see data for "with antihalation layer"). In the case of support D which is outside the scope of the invention in respect of transmission density, the antihalation layer has no such effect, and from this it can be seen that the invention is effectively applicable to a support having a transmission density of less than 0.8. It is noted in this connection that support D is of a large transmission density and is quite thick, which is contrary to the basic demand for a photosensitive material having a thin base.

EXAMPLE 2

In this example, in order to ascertain the effect of the invention further, highly sensitive reversal color photographic paper emulsion layers as mentioned below were prepared and the were coated on a support in order of proximity to the base, that is, antihalation layer, red sensitive emulsion layer, intermediate layer, green sensitive emulsion layer, yellow filter layer, blue sensitive emulsion layer, ultraviolet light absorbing layer, and protective layer. For the purpose of comparison, samples having no antihalation layer were also prepared.

Antihalation Layer

A 2.6% gelatin solution containing 5 g of gray colloidal silver produced by reduction in the presence of an alkaline weak reduction agent, unreacted weak reduction agent having been removed by noodle washing method after neutralization, 3 g of 2,5-dioctylhydroquinone dispersed in dibutylphthalate, and surface active agent [S-1] was prepared. Coating was effected so that the coating weight of colloidal silver was 0.12 g/m$^2$.

Red Sensitive Emulsion Layer

One mol of iodobromochloride silver emulsion having a mean particle diameter of 0.4 μm and composed of 3 mol % of silver iodide and 90 mol % of silver bromide was prepared by a neutral conversion method. After precipitation washing, 5 mg of sodium thiosulfate and 10 mg of thiocyanoaurate were added and second irpening was carried out. Then, 100 mg of a sensitizing dye [D-3] and 50 mg of a sensitizing dye [D-4] were added.

Further, stabilizers [T-4] and [T-2], surface active agent [S-2], a protect-dispersed coupler solution containing dibutylphthalate, ethyl acetate, a surfce active agent [S-2], 2,5-dioctylhydroquinone, and cyan couplers [CC-1] and [CC-2] were added.

Gelatin was added. Coating was carried out so that the coating weight of silver in the emulsion layer was 0.48 g/m$^2$.

First Intermediate Layer

A 3.0% gelatin solution containing 5 g of same gray colloidal silver as used in aforesaid antihalation layer, and 3 g of 2,5-dioctylhydroquinone dispersed in dibutylphthalate, and surface active agent [S-2] was prepared. Hardening agent [H-1] was added before coating. Coating was effected so that the layer had a colloidal silver takeup of 0.06 g/m$^2$.

Green Sensitive Emulsion Layer

One mol of a silver iodochloride emulsion having a mean particle diameter of 0.47 μm and containing 3 mol % of silver iodide and 90 mol % of silver bromide was prepared by neutral conversion method. After precipitation washing, 7 mg of sodium thiosulfate and 15 mg of thiocyanoaurate was added and second ripening was carried out. 90 mg of sensitizing dye [D-2] and 10 mg of sensitizing dye [D-5] were added. Further, 1 g of stabilizing agent [T-1] and 50 mg of stabilizing agent [T-2] were added. Then, a protect-dispersed magenta coupler solution composed of surface active agent [S-1], 2,5-dioctyl hydroquinone, magenta coupler [MC-1], dioctylphthalate, and ethyl acetate was added. Gelatin was added, then hardening agent [H-1] was added. Coating was effected so that the coating weight of silver was 0.4 g/m$^2$.

Yellow Filter Layer

To a protect-dispersed solution composed of dioctyl phthalate, ethyl acetate, surface active agent [S-1], and 2,5-dioctylhydroquinone was added a yellow colloidal silver. Then, surface active agent [S-2] and hardening agent [H-1] were added. Coating was carried out so that the coating weight of colloidal silver was 0.12 g/m$^2$.

Blue Sensitive Emulsion Layer

One mol of silver iodobromide having a mean particle diameter of 0.7 μm and containing 3.6% of silver iodide was prepared by neutral conversion method. After precipitation washing, 7 mg of sodium thiosulfate and 15 mg of thiocyanoaurate were added and second ripening was carried out. 90 mg of sensitizing agent [D-2] and 10 mg of [D-2] were added. Further, 1 mg of stabilizing agent [T-1] and 50 mg of [T-2] were added. Then, a protect-dispersion containing surface active agent [S-1], 2,5-dioctylhydroquinone, yellow coupler [YC-1], ethyl acetate, and dioctylphthalate was added. Gelatin was added, then hardening agent [H-1]. Coating was carried out so that the coating weight of silver was 0.58 g/m$^2$.

Ultraviolet Light Absorbing Layer

A protect-dispersion containing surface active agent [S-1], a ultraviolet light absorbing agent "Tinuvin 320", a product of Ciba Geigy, dibutyl phthalate, and ethyl acetate was prepared. Coating was carried out so that the coating weight of Tinuvin was 0.5 g/m$^2$.

Protective Layer

A gelatin solution containing colloidal silica, coating aid [S-3], and hardening agent [H-2] was used. Coating was made so that the coating weight of gelatin was 0.8 g/m$^2$.

Individual substances used in this example were same as those used in Example 1, except that [D-5] and [S-5] were as shown below.

(D-5)

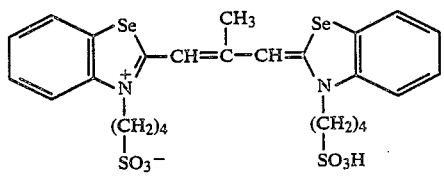

(S-3)

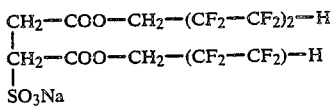

Individual samples, coated and dried, were aged by heating at 40° C. for 5 days before they were made into specimens. Each sample was subjected to the following processing stages for reversal development.

Processing stages

| | | | |
|---|---|---|---|
| (I) | First development | 38° C. | 1 min 15 sec |
| (II) | Washing | 35~38° C. | 45 sec |
| (III) | 2nd exposure | — | more than 200 CMS |
| (IV) | Color development | 38° C. | 1 min 30 sec |
| (V) | Washing | 30~38° C. | 15 sec |
| (VI) | Bleach/fix | 35~38° C. | 2 min |
| (VII) | Washing | 30~38° C. | 1 min 45 sec |
| (VIII) | Drying | 75~80° C. | 1 min |

Compositions of processing solutions were as follows:

First Developing Solution

| | |
|---|---|
| Sodium hexamethaphosphate | 2.0 g |
| 1-phenyl-3-pyrazolidone | 0.5 g |
| Sulfurous anhydride | 50.0 g |
| Hydroquinone | 6.0 g |
| Sodium carbonic anhydride | 30.0 g |
| Potassium bromide | 0.7 g |
| Sodium thiocyanate | 1.5 g |
| 6-nitrobenzimidazole nitrate | 0.8 g |
| Potassium iodide | 0.01 g |

-continued

| | |
|---|---|
| Water was added to a total quantity of 1.0 l. | |

Color Developer

| | |
|---|---|
| Benzil alcohol | 6.0 ml |
| Sodium hexamethaphosphate | 2.0 g |
| Sodium carbonate, anhydride | 5.0 g |
| Sodium secondary phosphate | 40.0 g |
| Potassium bromide | 0.25 g |
| Potassium iodide | 0.01 g |
| Sodium hydroxide | 6.5 g |
| Ethylenediamine sulfate | 7.8 g |
| Hydroxylamine sulfate | 2.2 g |
| N-ethyl-N-β-methanesulfonamidoethyl-aminoaniline lactate | 5.0 g |

Water was added to a total quantity of 1.0 l.

Bleach/Fix Solution

| | |
|---|---|
| Ammonium thiosulfate | 100.0 g |
| Ammonium ferric ethylenediaminetetra acetate | 60.0 g |
| Diammonium ethylenediaminetetra acetate | 5.0 g |
| Sodium sulfite, anhydride | 2.7 g |
| Thiourea | 1.0 g |

Water was added to a total quantity of 1.0 l.

Individual specimens processed in above mentioned manner were examined in respect of sharpness on the basis of their respective density ratios measured in same way as in Example 1. Their respective support constructions, "with antihalation layer" or "without antihalation layer," and density ratios processing are shown in Table 2. For white polyethylene layer, same one as in Example 1 was used.

TABLE 2

| Support | A | | B | | C | | D | |
|---|---|---|---|---|---|---|---|---|
| Thickness | | | | | | | | |
| Total | 80 | | 100 | | 135 | | 230 | |
| White polyethylene layer | 21 | | 25 | | 25 | | 34 | |
| Paper layer | 39 | | 54 | | 89 | | 166 | |
| Polyethylene layer backside | 20 | | 21 | | 21 | | 30 | |
| Transmission density | 0.54 | | 0.61 | | 0.72 | | 1.01 | |
| Antihalation layer | With | Without | With | Without | With | Without | With | Without |
| Density ratio | 0.62 | 0.23 | 0.74 | 0.34 | 0.78 | 0.45 | 0.80 | 0.71 |
| Invention/reference | Invention | Reference | Invention | Reference | Invention | Reference | Reference | Reference |

As can be understood from Table 2, if the transmission density of a base in low, the density ratio obtainable is very low unless an antihalation layer is provided, see the data for bases A–C without antihalation layer. In the case of a support having a transmission density of 1.01 (support D), the effect of an antihalation layer thereon is rather small. It can be seen from this that if a base having a low transmission density is provided with an antihalation layer, considerable improvement will result in density ratio.

These samples were used in producing prints from slides, and it was found that specimens having an antihalation layer produced very good prints, whereas those without such layer produced prints on a yellowish tone insofar as the reproduction of minor portions is concerned, the prints being therefore of low image quality with a low degree of sharpness.

EXAMPLE 3

In conjunction with the preparation of red sensitive and green sensitive emultions as used in Example 1, $2\times10^{-4}$ mol of a water soluble rhodium chloride was added to A1, A2, A3 liquids.

Samples having, in order of proximity to the base, red, green, and blue sensitive emulsion layers (C, M, Y in ascending order from the lowermost layer), and those having in same order, blue, green, and red sensitive emulsion layers (Y, M, C in ascending order from the lowermost) were prepared and compared, one with another. An intermediate layer identical with the second intermediate layer in Example 1 was provided, and other intermediate layers provided as 6th and 7th intermediate layers in Example 1 were omitted. The effect of such contrary arrangement of sensitive layers in the specimens was examined.

Test results are shown in Table 3. In the present example, support B in Example 1 was used. The three layers, blue, green, and red, were individually examined in respect of density ratio.

TABLE 3

| Layer arrangement | Y M C (Base side) | | | C M Y (Base side) | | |
|---|---|---|---|---|---|---|
| Antihalation layer | With | | Without | With | | Without |
| Support | B | | | A | | |
| Density ratio | Blue | 0.83 | 0.82 | Red | 0.88 | 0.85 |
| | Green | 0.74 | 0.52 | Green | 0.73 | 0.55 |
| | Red | 0.75 | 0.35 | Blue | 0.72 | 0.27 |
| Invention/ reference | Invention | | Reference | Invention | | Reference |

As can be seen from Table 3, samples having, in ascending order from the lowermost C, M, and Y layers, and those having Y, M, C layers, all showed low density ratios, say at 0.35 and 0.27, in their lowermost layers, where no antihalation layer was provided. Where an antihalation layer was provided, there was observed considerable improvement, say to 0.75 and 0.72.

However, where the lowermost layer was a blue sensitive layer (a yellow forming layer), there was no visibly noticeable deterioration in sharpness, irrespective of the presence or absence of an antihalation layer, even if there was actually some difference in density ratio.

On the other hand, where the lowermost layer was a red sensitive layer (a cyan forming layer), the effect of an antihalation layer was clearly observed, even to the eye. (In fact, such difference is not particularly discriminatable by the eye, but such discrimination was actually possible because cyan and magenta are considered to be easier to discriminate from other colors.) Thus, it can be seen that the invention is effectively applicable to photosensitive materials having, in order of proximity to the base, C, M, and Y layers.

EXAMPLE 4

An anti-halation layer, prepared as described below, and a first intermediate layer (an auxiliary layer) are simultaneously coated onto a support made of polyethylene-laminated paper of 110 micrometers and having a backing layer, and dried. Transmission density of the laminated paper was 0.65.

Anti-halation layer (first layer)

A small quantity of coating aid (S-2) was added to a gelatin solution containing colloidal gray silver of 5 g to prepare a coating solution, and the coating solution was applied onto the support so that the coating weight of the colloidal silver was 0.15 g/m$^2$. At this time, samples of No. 2 to No. 8 according to the present invention, each of which had a different thickness of the anti-halation layer, were prepared by changing the quantity of the gelatin coated onto the support. The sample No. 1 was for comparison having no antihalation layer (first layer) provided.

First intermediate layer (second layer)

Coating aid (S-2) and hardening agent (H-3) were added to gelatin solution, and the coating solution was applied onto the support so that the coating weight of the gelatin coated onto each sample support described above was as shown in Table 4 using the same manner as the first layer.

TABLE 4

| halation layer Sample No. | Coating weight of gelatin in anti-halation layer (g/m$^2$) | (thickness) | Coating weight of gelatin in anti-halation layer (g/m$^2$) | (thickness) | Coating weight of gelatin in anti- (g/m$^2$) | (thickness) |
|---|---|---|---|---|---|---|
| 1. For comparison | — | | — | | — | |
| 2. | 0.7 g/m$^2$ | (0.5μ) | 0.7 g/m$^2$ | (0.5μ) | 1.35 g/m$^2$ | (1.0μ) |
| 3. | 1.35 g/m$^2$ | (1.0μ) | 0.7 g/m$^2$ | (0.5μ) | 2.05 g/m$^2$ | (1.5μ) |
| 4. | 2.05 g/m$^2$ | (1.5μ) | 0.7 g/m$^2$ | (0.5μ) | 2.75 g/m$^2$ | (2.0μ) |
| 5. | 3.4 g/m$^2$ | (2.5μ) | 0.7 g/m$^2$ | (0.5μ) | 4.10 g/m$^2$ | (3.0μ) |
| 6. | 2.75 g/m$^2$ | (2.0μ) | 1.35 g/m$^2$ | (1.0μ) | 4.10 g/m$^2$ | (3.0μ) |
| 7. | 4.8 g/m$^2$ | (3.5μ) | 0.7 g/m$^2$ | (0.5μ) | 5.5 g/m$^2$ | (4.0μ) |
| 8. | 6.15 g/m$^2$ | (4.5μ) | 0.7 g/m$^2$ | (0.5μ) | 6.85 g/m$^2$ | (5.0μ) |

Onto the support coated with the anti-halation layer and the first intermediate layer, each emulsion layer from the red-sensitive emulsion layer (third layer) to the protective layer (eleventh layer) was sequentially applied according to the following procedures, and dried. Onto the support of the sample for comparison, the above-mentioned emulsions were directly applied and dried.

Red-sensitive emulsion layer (third layer)

An inactive gelatin solution of 2.0% was maintained at 50° C. and the A and B solution shown below were simultaneously poured into the solution over a period of three minutes while stirring the gelatin solution. Ten minutes after, the C solution was poured and added in the solution over a period of three minutes. After ripening the solution for 40 minutes, excess salt was removed by water-rinsing precipitate. The D and E solutions were added into the emulsion to laminate, onto the core surface of individual grain, silver chloro-bromide consisting of 95 mol % AgCl and 5 mol % AgBr. Excess soluble salt was removed again by water-rinsing precipitate. A small quantity of gelatin was added to disperse the precipitate.

| | | |
|---|---|---|
| A solution | Pure water | 500 ml |
| | NaCl | 40 g |
| | KBr | 8.9 g |
| | KI | 0.4 g |
| B solution | Pure water | 600 ml |
| | $AgNO_3$ | 85 g |
| C solution | Pure water | 600 ml |
| | KBr | 50.6 g |
| D solution | Pure water | 1500 ml |
| | NaCl | 20 g |
| | KBr | 1.8 g |
| E solution | Pure water | 500 ml |
| | $AgNO_3$ | 51 g |

After this step, the following agents were added into the silver halide emulsion by appropriate quantities: sensitization dye (D-4); sensitization dye (D-5); solution containing 2,5-dioctylhydroquinone protectively dispersed with dibutylphthalate and cyan coupler (CC-3); 4-hydroxy-6-methyl-1,3,3a,7-tetrazaindene; 1-phenyl-5-merucaptotetrazole; gelatin; and coating aid (S-1). Finally, the emulsion was applied onto the support so that the coating weight of silver applied was 0.4 g/m$^2$.

Second intermediate layer (forth layer)

A gelatin solution containing 2,5-dioctylhydroquinone dispersed in dioctylphthalate, TINUVIN 328 (ultra violet radiation absorbing agent produced by CIBA GEIGY AG), and coating aid (S-1) was prepared and applied onto the support so that the coating weight of TINUVIN 328 applied was 0.15 g/m$^2$.

Green-sensitive emulsion layer (fifth layer)

Silver halide emulsion was prepared using the same manner as the red-sensitive emulsion. The following agents were added into the silver halide emulsion by appropriate quantities: sensitization dye (D-2); solution containing 2,5-dioctylhydroquinone protectively dispersed with dibutylphthalate and magenta coupler (MC-2); 4-hydroxy-6-methyl-1,3,3a,7-tetrazaindene; 1-phenyl-5-merucaptotetrazole; gelatin; and coating aid (S-3). Finally, the emulsion was applied onto the support so that the coating weight of silver applied was 0.4 g/m$^2$.

Third intermediate layer (sixth layer)

Using the same manner as the first intermediate layer, TINUVIN 328 was applied by 0.2 g/m$^2$.

Yellow filter layer (seventh layer)

Into a solution containing yellow colloidal silver produced by reducing silver nitrate under the presence of alkaline weak reducing agent (the reducing agent was removed by the Noodle rinsing method carried out after neutralization process) and 2,5-dioctylhydroquinone solution protectively dispersed in dibutylphthalate, coating aid (S-2), and hardening agent (H-2) (added immedaitely before the application process) were added, mixed, and applied onto the support so that the coating weight of silver applied was 0.15 g/m$^2$.

Fourth intermediate layer (eighth layer)

Using the same manner as the second intermediate layer, TINUVIN 328 was applied by 0.15 g/m$^2$.

Blue-sensitive emulsion layer (ninth layer)

An inactive gelatin solution of 1.5% was maintained at 60° C. and the A and B solutions shown below were simultaneously poured into the solution over a period of 15 minutes while stirring the gelatin solution. Fifteen minutes after, the C solution was poured over a period of two minutes, and ripened for 40 minutes. After removing excess salt by water-rinsing precipitate, the D and E solutions shown below were added into the emulsion to laminate, onto the surface of individual grain, shell consisting of 97 mol % AgCl and 3 mol % AgBr. Excess soluble salt was removed again by water-rinsing precipitate. Gelatin was added to disperse precipitate.

| | | |
|---|---|---|
| A solution | Pure water | 1000 ml |
| | NaCl | 76 g |
| | KBr | 17 g |
| | Hexachloroiridate (III) salt | 2 × 10 g |
| B solution | Pure water | 1000 ml |
| | $AgNO_3$ | 169.9 g |
| C solution | Pure water | 800 ml |
| | KBr | 103 g |
| | KI | 3.3 g |
| D solution | Pure water | 500 ml |
| | $AgNO_3$ | 51 g |
| E solution | Pure water | 500 ml |
| | NaCl | 25.8 g |
| | KBr | 1.1 g |

After this step, the following agents were added into the silver halide emulsion by appropriate quantities: sensitization dye (D-1); solution containing yellow coupler (YC-1) dispersed into dioctylphthalate; 2-mercaptobenzothiazole; 4-hydroxy-6-methyl-1,3,3a,7-tetrazaindene; gelatin, coating aid (S-3); and hardening agent (H-1) (added immedaitely before the application process). Finally, the emulsion was applied onto the support so that the coating weight of silver applied was 0.5 g/m$^2$.

Fifth intermediate layer (tenth layer)

Using the same manner as the second intermediate layer, TINUVIN 328 was applied by 0.3 g/m$^2$. Into the solution, however, hardening agent (H-1) was added immediately before the application process.

Protective layer (eleventh layer)

The gelatin solution containing colloidal silica having a mean grain size of 3 microns, coating aid (S-3), hardening agent (H-1 and H-3 (added immediately before the application process)) was applied onto the support so that the coating weight of gelatin applied was 1.0 g/m$^2$. Thus, each sample was prepared.

Cyan coupler (CC-3)

-continued

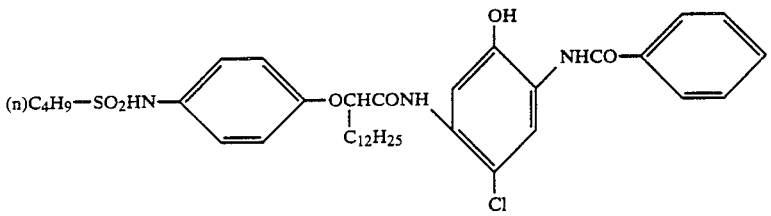

Magenta coupler (MC-2)

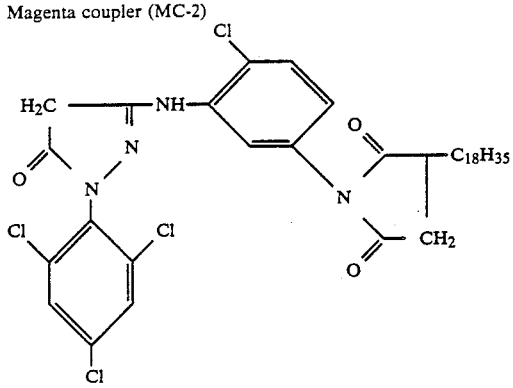

Sensitization dye (D-5)

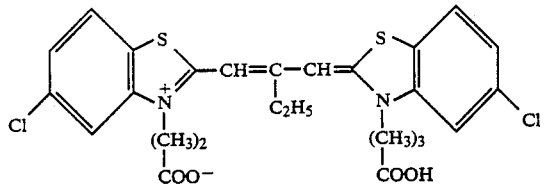

Coating aid (S-3)

$CH_2—COOCH_2(CF_2CF_2)_2H$
|
$CH—COOCH_2(CF_2CF_2)_3H$
|
$SO_3Na$

Each sample as prepared above was subjected to wedge exposure using the KS-7 type photographic sensitometer (manufactured by Konishiroku Photo Industry Co., Ltd.), then subjected to the development processes under the conditions the same as the condition of Example 1.

The gamma 1 values ($\gamma_1$) of blue light (B), green light (G), and red light (R), and the minimum density (Dmin) values of the samples No. 1 to No. 8 processed above are listed in Table 2. The $\gamma_1$ value is the tangent value of each angle formed between the axis of abscissa and the line connecting points taken on the characteristic curve corresponding to the densities 0.15 and 0.5, representing the contrast of image.

In addition, the dot reproducibility of each sample was tested by the following steps; dot wedge (150 lines/inch) is set on the sample surface, and exposed for determining resolution with each light of blue (B), green (G), and red (R), and dot reproducibility was tested, using the AREA DUCK (manufactured by Konishiroku Photo Industry Co., Ltd.), after being subjected to the above-mentioned developing process..

TABLE 5

| Sample | $\gamma_1$ | | | Dmin | | | Dot reproducibility | | |
|---|---|---|---|---|---|---|---|---|---|
| No. | B | G | R | B | G | R | B | G | R |
| 1. | 1.03, | 1.03 | 1.02 | 0.07, | 0.07, | 0.06 | 5 ~ 10% | 30% | 30% |
| 2. | 1.03, | 1.03, | 1.02 | 0.08, | 0.07, | 0.06 | 5 ~ 10% | 5 ~ 10% | 5 ~ 0% |
| 3. | 1.03, | 1.03, | 1.02 | 0.08, | 0.07, | 0.06 | " | " | " |
| 4. | 1.02, | 1.02, | 1.00 | 0.09, | 0.07, | 0.06 | " | " | " |
| 5. | 1.00, | 1.01, | 0.99 | 0.09, | 0.08, | 0.06 | " | " | " |
| 6. | 0.99, | 1.00, | 1.00 | 0.09, | 0.08, | 0.06 | " | " | " |
| 7. | 0.98, | 0.99, | 0.99 | 0.10, | 0.09, | 0.07 | " | " | " |
| 8. | 0.92, | 0.93, | 0.92 | 0.14, | 0.13, | 0.12 | " | " | " |

As clearly shown in Table 5, the dot reproducibility of the samples from No. 2 to No. 8, having an anti-halation layer formed under the emulsion layer, was significantly improved (from 30% to 5–15%), especially for green light (G) and red light (R). The degradation in $\gamma_1$ and (Dmin) caused by forming the anti-halation layer was able to be compensated by limiting the total thickness of the anti-halation layer (first layer) and the first intermediate layer (second layer) to less than 4 microns, preferably, to less than 3 microns. This was clearly revealed by the improvement of contrast in the shadow part.

On the contrary, it is difficult to form an anti-halation layer of thinner than 1 micrometer. Therefore, it is preferable to form an anti-halation layer of thicker than 1 micron. That is, it is preferable that the total thickness of the anti-halation layer (first layer) and the first intermediate layer (second layer) is thinner than 4 micrometers, more preferably, it is within a range from 1.0 micrometer to 3.0 micrometers.

EXAMPLE 5

The samples from No. 2-1 to 2-4 listed in Table 3 were prepared by forming the anti-halation layer (first layer) and the first intermediate layer (second layer) according to the procedures used for the sample No. 4 in Example-1 and by changing the quantity of binder (gelatin) used for the red-sensitive emulsion layer (third layer) to the protective layer (eleventh layer). However the quantities of silver, coupler, and the other additives coated were maintained at a constant. The quantity of hardening agent used was adjusted so that the level of hardened film was kept at a constant.

TABLE 6

| Sample No. | Coating weight of gelatin in first and second layers ($g/m^2$) (thickness) | Coating weight of gelatin in third to eleventh layer ($g/m^2$) (thickness) | Total coating amount of gelatin in entire photographic layers ($g/m^2$) (thickness) |
|---|---|---|---|
| 2-1 | 2.75 (2.0μ) | 7.2 (10.7μ) | 9.95 (12.8μ) |
| 2-2 | 2.75 (2.0μ) | 8.5 (11.8μ) | 11.25 (13.8μ) |
| 2-3 | 2.75 (2.0μ) | 10.0 (18.8μ) | 12.75 (14.8μ) |
| 2-4 | 2.75 (2.0μ) | 13.0 (15.1μ) | 15.75 (17.1μ) |

The above-prepared samples No. 2-1 to No. 2-4 were subjected to the wedge exposure and developing processes using the photographic sensitometer in the same manner as used in Example 1, and the obtained $\gamma_1$ and Dmin are listed in Table 7 below.

TABLE 7

| Sample No. | $\gamma_1$ B | $\gamma_1$ G | $\gamma_1$ R | Dmin B | Dmin G | Dmin R |
|---|---|---|---|---|---|---|
| 2-1 | 1.02, | 1.02, | 1.01 | 0.08, | 0.07, | 0.06 |
| 2-2 | 1.02, | 1.03, | 1.00 | 0.08, | 0.07, | 0.06 |
| 2-3 | 1.00, | 1.01, | 1.00 | 0.09, | 0.08, | 0.07 |
| 2-4 | 0.98, | 0.98, | 0.97 | 0.11, | 0.11, | 0.09 |

As clearly being understood by comparing the results shown in Tables 3 and 4 with the results of the sample No. 8 shown in Table 2, not only the total thickness of the anti-halation layer (first layer) and the first intermediate layer (second layer) but also the entire thickness of the emulsion layers affected $\gamma_1$ and Dmin. Therefore, it is preferable to limit the total thickness of the anti-halation layer (first layer) and the first intermediate layer (second layer) to less than 4 microns, moreover to limit the entire thicknes to less than 15 microns. Especially, it was revealed that the dot reproducibility is significantly improved as shown in Table 2 if the thickness is within the above-mentioned range, thus the photographic properties were also improved significantly.

It was also proved that limiting the entire thickness to less than 15 microns affected advantageously for the curling balance of the upper and bottom surfaces of photosensitive materials, drying ability, and developing ability.

EXAMPLE 6

Prior to the detailed description of the examples, the prescription of compounds (A)-(H) being represented by formula [I] (hereinafter related to as the compound of formula [I]) is described, being followed by the description of preparation of the light-sensitive material comprising a support, provided thereupon, photographic structural layers. The same laminated paper as used in Example 4 was used as the support.

(Prescription of the compound of formula [I])

A weighed amount of one of the compounds (A)-(H) was dissolved into acetic ester and dioctyl phthalate to prepare a solution. Then, the solution was blended with a prescribed amount of gelatin solution having sodium dodecylbenzine sulfonate, which aws homogenized with ultrasonic dispersion to prepare a dispersion having one of the compounds (A)-(H). During this course, when more than two of the compounds (A)-(H) were combinedly used, the amount of each compound was varied so that the total amount became a prescribed amount.

Anti-halation layer (first layer)

2.6% gelatin solution containing a grey colloidal silver prepared by reduction in the presence of a weak reducing agent (the weak reducing agent was removed, after neutralization, by a noodle washing process), a surface active agent (S-1) and a hardener (H-3), was prepared and applied and dried onto the support so that an amount of coated colloidal silver was 0.12 $g/m^2$ and an amount of applied gelatin was 0.9 $g/m^2$.

First intermediate layer (second layer)

A gelatin solution containing a surface active agent (S-2) and a hardener (H-2) was prepared and applied and dried onto the support so that an amount of applied gelatin was 0.9 $g/m^2$.

Red sensitive emulsion layer (third layer)

A silver halide emulsion was prepared in the same manner as that of the red-sensitive emulsion of Example 4 and appropriate quantities of the following agents were added into the anove silver halide emulsion by sensitizing dye (D-4); sensitizing dye (D-5); solution containing 2,5-dioctylhydroquinone and cyan coupler protectively dispersed with dibutyl phthalate (CC-3); 4-hydroxy-6-methyl-1,3,3a, 7-tetrazaindene; 1-phenyl-5-mercaptotetrazole; gelatin; and coating aid (S-1). Finally, the emulsion was applied onto the support so that the quantity of silver applied was 0.4 $g/m^2$.

Second intermediate layer (fourth layer)

A gelatin solution containing 2,5-dioctylhydroquinone and TINUVIN 328 (ultraviolet absorber produced by CIBA GEIGY AG) dispersed with dioctylphalate, and coating aid (S1), was prepared and applied onto the support so that the quantity of TINUVIN 328 applied was 0.15 g/m$^2$.

Green-sensitive emulsion layer (fifth layer)

A silver halide emulsion was prepared using the same manner as that of the red-sensitive emulsion. The following agents were added to the silver halide grains by appropriate quantities: sensitizing dye (D-2); solution containing 2,5-dioctylhydroquinone and magenta coupler (MC-2); protectively dispersed in dibutylphthalate 4-hydroxy 6-methyl-1,3,3a,7-tetrazaindene; 1-phenyl-5-mercaptotetrazole; gelatin; and coating aid (S-2). Finally, the emulsion was applied onto the support so that the quantity of silver applied was 0.4 g/m$^2$.

Third intermediate layer (sixth layer)

Using the same manner as the second intermediate layer, gelatin solution was applied so that the quantity of TINUVIN 328 applied was 0.2 g/m$^2$.

Yellow filter layer (seventh layer)

Into a solution containing yellow colloidal silver produced by reducing silver nitrate under the presence of weak alkali reducing agent (the reducing agent was removed by the Noodle rinsing method carried out after neutralization process) and 2,5-dioctylhydroquinone solution protectively dispersed in dibutylphthalate, coating aid (S-2), and hardener (H-2) (added immediately before the application process) were added, mixed, and applied onto the support so that the quantity of silver applied was 0.15 g/m$^2$.

Fourth interemediate layer (eighth layer)

Using the same manner as the first intermediate layer, TINUVIN 328 was applied at a rate of 0.15 g/m$^2$.

Blue-sensitive emulsion layer (ninth layer)

A silver halide emulsion was prepared in the same manner as that of the blue-sensitive emulsion of Example 4. And the following agents were added into the silver halide emulsion by appropriate quantities: sensitizing dye (D-1); solution containing yellow coupler (YC-1) dispersed into dioctylphthalate; 2-mercaptobenzothiazole; 4-hydroxy-6-methyl-1,3,3a,7-tetrazaindene; gelatin; coating aid (S-3); and hardener (H-1) (added immediately before the application process). Finally, the emulsion was applied onto the support so that the quantity of silver applied was 0.5 g/m$^2$.

Fifth intermediate layer (tenth layer)

Using the same manner as the first intermediate layer, TINUVIN 328 was applied by 0.3 g/m$^2$. Into the emulsion, however, hardener was added immediately before it was applied.

Protective layer (eleventh layer)

The gelatin solution containing colloidal silica of 3 mean particle size, coating aid (S-3), hardener (H-1) and (H-3) (added immediately before the application process) was applied onto the support so that the quantity of gelatin applied was 1.0 g/m$^2$.

In this example, the dispersions correspondingly having the compounds of formula [I] obtained by the previously-mentioned prescription were blended with corresponding coating solutions to form anti-halation layers. Then the blends were applied onto the corresponding supports, whereby two type of anti-halation layers were formed by using each blend; the anti-halation layers independently having one of the compounds (A) through (H) at a rate of 0.01 g/m$^2$ or 0.05 g/m$^2$. Further, upon each of the anti-halation layers, the photographic structure layers such as the first intermediate layer, the red sensitive emulsion layer and others were sequentially formed to obtain the corresponding light-sensitive materials of the invention. The samples obtained by correspondingly adding the compounds (A) through (H) in this manner were deisgnated the samples No. 12 through No. 27. Additionally, the sample No. 11 was a comparison sample not having any of the above compounds. And the values of gamma-1 ($\gamma_1$) and minimum density (Dmin) measured with every sample respectively with three homogeneous light, blue, green and red, are shown in Table 8, below; wherein $\gamma_1$ is a tangent value determined by the angle formed between the intersect of characteristic curve corresponding to the densities 0.15 to 0.5, and the horizontal line stretching from the coordinate representing the initial density, and indicates a degree of contrast. Dmin represents a minimum density. The results obtained by the experiment have revealed that the $\gamma_1$ values of each of the samples No. 12 through No. 27 are larger than those of the sample No. 11, indicating that each of the samples No. 2 through No. 27 has a higher contrast and clear-cut toe in the characteristic curve, and have also revealed that the Dmin values of each of the samples No. 12 through No. 27 are smaller than those of the sample No. 11, indicating that each of the samples No. 12 through No. 27 has a more satisfactory whiteness due to reduced stains. This means that each of the samples No. 12 through No.27 is more excellent in color reproducibility than the sample No. 11.

TABLE 8

| Sample No. | Compound | Addition g/m$^2$ | $\gamma_1$ B | $\gamma_1$ G | $\gamma_1$ R | Dmin B | Dmin G | Dmin R |
|---|---|---|---|---|---|---|---|---|
| 11 | Comparison (No addition) | | 0.95, | 0.96, | 0.95 | 0.12, | 0.10, | 0.08 |
| 12 | (A) | 0.01 | 1.06, | 1.06, | 1.06 | 0.09, | 0.08, | 0.06 |
| 13 | | 0.05 | 1.10, | 1.08, | 1.09 | 0.06, | 0.06, | 0.04 |
| 14 | (B) | 0.01 | 1.02, | 1.03, | 1.05 | 0.10, | 0.09, | 0.06 |
| 15 | | 0.05 | 1.05, | 1.06, | 1.08 | 0.07, | 0.06, | 0.04 |
| 16 | (C) | 0.01 | 0.98, | 0.99, | 1.01 | 0.11, | 0.10, | 0.08 |
| 17 | | 0.05 | 1.04, | 1.05, | 1.08 | 0.08, | 0.08, | 0.04 |
| 18 | (D) | 0.01 | 0.97, | 0.99, | 1.00 | 0.11, | 0.10, | 0.07 |
| 19 | | 0.05 | 1.03, | 1.05, | 1.09 | 0.08, | 0.08, | 0.04 |
| 20 | (E) | 0.01 | 1.10, | 1.08, | 1.06 | 0.09, | 0.08, | 0.05 |
| 21 | | 0.05 | 1.16, | 1.12, | 1.11 | 0.06, | 0.05, | 0.03 |

TABLE 8-continued

| Sample No. | Compound | Addition g/m² | γ1 B | γ1 G | γ1 R | Dmin B | Dmin G | Dmin R |
|---|---|---|---|---|---|---|---|---|
| 22 | (F) | 0.01 | 1.05, | 1.06, | 1.05 | 0.08, | 0.08, | 0.05 |
| 23 | | 0.05 | 1.10, | 1.09, | 1.14 | 0.06, | 0.06, | 0.03 |
| 24 | (G) | 0.01 | 1.04, | 1.05, | 1.06 | 0.08, | 0.07, | 0.05 |
| 25 | | 0.05 | 1.10, | 1.10, | 1.09 | 0.06, | 0.06, | 0.03 |
| 26 | (H) | 0.01 | 1.05, | 1.06, | 1.04 | 0.09, | 0.08, | 0.06 |
| 27 | | 0.05 | 1.11, | 1.12, | 1.08 | 0.06, | 0.06, | 0.03 |

EXAMPLE 7

In this example, the dispersions having the above-mentioned compounds of the invention were applied onto the corresponding anti-halation layer on the supports in order to correspondingly form the first intermediate layers adjacent to the anti-halation layers; the first intermediate layers independently having one of the compounds at a rate of 0.03 g/m². Further, upon each of the first intermediate layers, other photographic structural layers were sequentially superposed to obtain the corresponding light-sensitive material. The samples of the light-sensitive materials obtained by this process were correspondingly designated the samples No. 28 through No. 36. The results obtained by measuring the $\gamma_1$, and minimum density for every sample in the same way as in Example 6 are shown in Table 7, below. The results in Table 7 reveals, like the results in Table 1, that each of the light-sensitive materials individually having one of the compounds of the invention is more excellent in contrast and minimum density than the similar one having no addition of any of the compounds.

TABLE 9

| Sample No. | Compound | Addition g/m² | γ1 B | γ1 G | γ1 R | Dmin B | Dmin G | Dmin R |
|---|---|---|---|---|---|---|---|---|
| 28 | Comparison (No addition) | 0 | 0.96, | 0.96, | 0.95 | 0.12, | 0.10, | 0.08 |
| 29 | (A) | 0.03 | 1.09, | 1.08, | 1.08 | 0.07, | 0.06, | 0.04 |
| 30 | (B) | 0.03 | 1.03, | 1.07, | 1.08 | 0.08, | 0.07, | 0.04 |
| 31 | (C) | 0.03 | 1.02, | 1.03, | 1.05 | 0.07, | 0.08, | 0.05 |
| 32 | (D) | 0.03 | 1.01, | 1.03, | 1.07 | 0.10, | 0.08, | 0.05 |
| 33 | (E) | 0.03 | 1.12, | 1.09, | 1.08 | 0.07, | 0.06, | 0.04 |
| 34 | (F) | 0.03 | 1.07, | 1.08, | 1.10 | 0.07, | 0.07, | 0.04 |
| 35 | (G) | 0.03 | 1.07, | 1.07, | 1.07 | 0.07, | 0.07, | 0.04 |
| 36 | (H) | 0.03 | 1.08, | 1.09, | 1.06 | 0.07, | 0.07, | 0.05 |

EXAMPLE 8

In this example, any of the above compounds prepared in Example 6 was added to any of the photographic structural layers other than the layers identical to those where the compounds were added in Example 6 and 7 so as to prepare the samples No. 40 through No. 44. The results obtained by examining these samples are shown in Table 10. And the sample No. 29 in this table is a comparison sample not having any of the above compounds. The results have revealed by comparing these samples, like the results in the previously-mentioned examples, that each of the samples having any of the compounds of the invention is more excellent in contrast than the comparison sample.

TABLE 10

| Sample No. | Position of addition in the photographic component layers | γ1 B | γ1 G | γ1 R | Dmin B | Dmin G | Dmin R |
|---|---|---|---|---|---|---|---|
| 39 | No addition (Comparative) | 0.96, | 0.96, | 0.95 | 0.12, | 0.11, | 0.08 |
| 40 | Third layer | 1.10, | 1.08, | 1.09 | 0.06, | 0.06, | 0.04 |
| 41 | Second layer | 1.10, | 1.09, | 1.09 | 0.06, | 0.05, | 0.04 |
| 42 | Third layer + Fifth layer | 1.10, | 1.08, | 1.08 | 0.06, | 0.06, | 0.04 |
| 43 | Fifth layer | 1.11, | 1.10, | 1.08 | 0.05, | 0.05, | 0.05 |
| 44 | Second layer + Fourth layer | 1.10, | 1.09, | 1.09 | 0.06, | 0.05, | 0.04 |

What is claimed is:

1. A method of forming a color photographic image comprising the steps of:

a. imagewise exposing to light a silver halide color photographic light-sensitive material comprising a light reflective support having a light transmission density of not more than 0.8, having thereon, a photographic component comprising, in order of proximity to said support, at least one antihalation layer having a thickness within the range of 1 to 3 μm, a silver halide emulsion layer containing a cyan coupler, a silver halide emulsion layer containing a magenta coupler, and a silver halide emulsion layer containing a yellow coupler;

b. developing said photographic material with a color developing solution; and c. treating said photographic material with a solution having a fixing ability.

2. The method of forming a color photographic image of claim 1, wherein said silver halide emulsion layers containing a cyan coupler, a magenta coupler and a yellow coupler, respectively, each contain a direct positive type silver halide emulsion on which a direct positive image is formed by light-fogging.

3. The silver halide photographic light-sensitive material of claim 1, wherein at least one layer of said photographic component layer contains a compound represented by formula I;

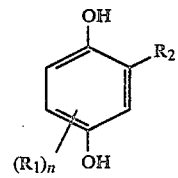

I wherein $R_1$ and $R_2$ are each a hydrogen atom or an alkyl group having 1 to 5 carbon atoms; and n is an integer of 1, 2 or 3.

* * * * *

UNITED STATES PATENT AND TRADEMARK OFFICE

CERTIFICATE OF CORRECTION

PATENT NO. : 4,990,432

DATED : February 05, 1991

INVENTOR(S) : Hajime Komatsu et al.

It is certified that error appears in the above-identified patent and that said Letters Patent is hereby corrected as shown below:

On the Title page, Item [54] change "Hoshimo" to

--Hoshino--.

Signed and Sealed this

Twenty-second Day of December, 1992

*Attest:*

DOUGLAS B. COMER

*Attesting Officer*

*Acting Commissioner of Patents and Trademarks*